US009802774B2

(12) United States Patent
Lee et al.

(10) Patent No.: US 9,802,774 B2
(45) Date of Patent: Oct. 31, 2017

(54) IMAGE FORMING APPARATUS

(71) Applicant: SAMSUNG ELECTRONICS CO., LTD., Suwon-si, Gyeonggi-do (KR)

(72) Inventors: Seung Sup Lee, Suwon-si (KR); Jung Yun Won, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/075,966

(22) Filed: Mar. 21, 2016

(65) Prior Publication Data

US 2016/0340135 A1 Nov. 24, 2016

(30) Foreign Application Priority Data

May 22, 2015 (KR) ..... 10-2015-0072072

(51) Int. Cl.
*B65H 5/26* (2006.01)
*B65H 5/36* (2006.01)
(Continued)

(52) U.S. Cl.
CPC ..... *B65H 5/26* (2013.01); *B65H 5/062* (2013.01); *B65H 5/36* (2013.01); *G03G 15/6529* (2013.01);
(Continued)

(58) Field of Classification Search
CPC . B65H 5/062; B65H 5/26; B65H 5/36; B65H 2404/74; B65H 2404/741;
(Continued)

(56) References Cited

U.S. PATENT DOCUMENTS 4,464,042 A * 8/1984 Omori ..... B65H 5/36 399/316
5,368,290 A * 11/1994 Nanba ..... B41J 13/00 271/273
(Continued)

FOREIGN PATENT DOCUMENTS

EP 1 970 768 A2 9/2008
EP 1 970 768 A3 12/2008
(Continued)

OTHER PUBLICATIONS

Extended European Search Report dated Oct. 31, 2016 in corresponding European Patent Application No. 16162027.3.
(Continued)

*Primary Examiner* — David H Bollinger
(74) *Attorney, Agent, or Firm* — Staas & Halsey LLP

(57) ABSTRACT

An image forming apparatus includes a developing device, a plurality of feeding and delivering paths through which a printing medium is delivered to the developing device, a feeding roller unit which forms a developing and delivering path in which the plurality of feeding and delivering paths are joined and delivers the printing medium to the developing device, and a guide unit which guides the printing medium passing through the plurality of feeding and delivering paths to the feeding roller unit and is rotatably provided to expose the plurality of feeding and delivering paths to the outside. In the above configuration, the printing medium jam problems inside the image forming apparatus are easily cleared.

20 Claims, 20 Drawing Sheets

(51) Int. Cl.

| | |
|---|---|
| ***B65H 5/06*** | (2006.01) |
| ***G03G 15/00*** | (2006.01) |
| ***G03G 21/16*** | (2006.01) |
| *B41J 13/10* | (2006.01) |

(52) U.S. Cl.
CPC ..... *G03G 21/1638* (2013.01); *B41J 13/103* (2013.01); *G03G 21/1695* (2013.01)

(58) Field of Classification Search
CPC ..... B65H 2404/7414; G03G 21/1638; G03G 15/6529; G03G 21/1695; B41J 13/103
USPC ..... 271/264, 272
See application file for complete search history.

(56) References Cited

U.S. PATENT DOCUMENTS 6,003,864 A * 12/1999 Kuo ..... B65H 5/062 271/188
2005/0230906 A1* 10/2005 Michel Loiselle ..... B65H 5/36 271/245
2007/0018384 A1 1/2007 Okoshi
2008/0205914 A1 8/2008 Jeon
2009/0067909 A1 3/2009 Kim et al.
2011/0091238 A1 4/2011 Nakazawa

FOREIGN PATENT DOCUMENTS

EP 2 199 238 A2 6/2010
EP 2 463 727 A1 6/2012
EP 2 199 238 A3 8/2012
KR 10-2008-0084143 9/2008

OTHER PUBLICATIONS

European Office Action under Rule 71(3) for European Application No. 16162027.3 dated Apr. 20, 2017.

* cited by examiner

IMAGE FORMING APPARATUS

CROSS-REFERENCE TO RELATED APPLICATION

This application claims the benefit of foreign priority to Korean Patent Application No. 10-2015-0072072, filed on May 22, 2015 in the Korean Intellectual Property Office, the disclosure of which is incorporated herein by reference.

BACKGROUND

1. Field

Embodiments of the present disclosure relate to an image forming apparatus, and more particularly, to an image forming apparatus with an improved structure through which a printing medium is easily supplied.

2. Related Art

Image forming apparatuses are devices for forming images on printing media according to input signals, and examples thereof include printers, copiers, fax machine, and all-in-one devices implemented by a combination thereof.

An electrophotographic image forming apparatus, one type of the image forming apparatus, includes a photosensitive unit having a photoreceptor therein, a charging unit which is disposed near the photosensitive unit and charges the photoreceptor to a predetermined potential level, a developing unit having a developing roller, and an optical scanning unit. The optical scanning unit applies light onto the photoreceptor charged to the predetermined potential level by the charging unit to form an electrostatic latent image on a surface of the photoreceptor, and the developing unit supplies developers onto the photoreceptor on which the electrostatic latent image is formed to form a visible image.

Printing medium supply devices which supply a printing medium to a developing unit may include a cassette type of a printing medium supply device which uses the printing medium stored therein, a multipurpose (MP) type of a printing medium supply device which may easily use various printing media in a small amount, and a second cassette feeder (SCF) of a printing medium supply device provided to supply a large amount of printing medium. As described above, there are various supplying types of a printing medium, and therefore, a plurality of feeding and delivering paths become formed.

Separately designing the plurality of feeding and delivering paths through which the printing medium is delivered to the developing unit is not effective in terms of using the inside space of the image forming apparatus, and has a disadvantage of requiring unnecessary components.

SUMMARY

Therefore, it is an aspect of the present disclosure to provide an image forming apparatus which is improved so that a printing medium jammed inside a main body is easily removed.

Also, it is another aspect of the present disclosure to provide an image forming apparatus capable of effectively solving the printing medium jam using a plurality of accessible printing medium delivering paths.

Additional aspects of the disclosure will be set forth in part in the description which follows and, in part, will be obvious from the description, or may be learned by practice of the disclosure.

In accordance with an aspect of the present disclosure, an image forming apparatus includes a main body, a printing medium supply device configured to supply a printing medium to the inside of the main body, a feeding roller device provided inside the main body to deliver the printing medium supplied from the printing medium supply device, and a guide unit disposed to guide the printing medium supplied from the printing medium supply device to the feeding roller device, wherein the guide unit includes a first guide member rotatable in a first direction to access the printing medium inside the main body when the printing medium is jammed, and a second guide member rotatably provided in the first direction together with the first guide member.

The second guide member may be fixed to the first guide member.

The guide unit may further include a first coupling member provided at the first guide member, a second coupling member provided at the second guide member so that the second coupling member is coupled with the first coupling member.

The first guide member and the second guide member may be formed integrally.

The first guide member may be rotatably coupled to the second guide member.

The first guide member may be relatively rotatable with respect to the second guide member.

The second guide member may be configured to be rotated along with the first guide member after the first guide member is rotated at a predetermined angle.

The guide unit may further include a movement limiting part provided to allow the first guide member to come in contact with and rotate the second guide member.

The movement limiting part may include a movement protrusion provided in one of the first guide member and the second guide member, and a movement rail provided in the other among the first guide member and the second guide member and by which the movement protrusion is relatively moved within a restricted section.

The guide unit may further include a first rotating part as the center of rotation while the first guide member is rotated with respect to the second guide member, and a second rotating part as the center of rotation while the first guide member is rotated together with the second guide member.

The feeding roller device may include a first feeding roller having a rotating shaft, and the first guide member and the second guide member are configured to be rotated around the rotating shaft.

The feeding roller device may further include a second feeding roller facing the first feeding roller, and the first feeding roller is moveable between a first position where the first feeding roller is in contact with the second feeding roller and a second position where the first feeding roller is separated from the second feeding roller so that the printing medium is delivered.

The first feeding roller may be moved to the second position in association with the rotation of the first guide member and the second guide member.

The feeding roller device may further include a lifting guide part which is in contact with the guide unit while the guide unit is rotated and guides the movement of the first feeding roller.

The feeding roller device may further include a roller bracket rotatably supporting the first feeding roller and including a roller rail to move the first feeding roller between the first position and the second position. The roller bracket may be in contact with at least one of the first guide member and the second guide member while the second guide member is rotated, and guides the movement of the first feeding roller.

The image forming apparatus may further include an elastic member which elastically biases the second guide member so that the second guide member is returned to an original position.

The image forming apparatus may further include an elastic member which elastically biases the first guide member so that the first guide member is returned to an original position with respect to the second guide member.

The first guide member may be disposed above the second guide member.

The printing medium supply device may include a first printing medium supply device and a second printing medium supply device which are provided at different positions in the main body. The first guide member may be disposed to guide the printing medium supplied from the first printing medium supply device to the feeding roller device, and the second guide member may be disposed to guide the printing medium supplied from the second printing medium supply device to the feeding roller device.

The first guide member and the second guide member may be disposed so that the printing medium supplied from the first printing medium supply device passes between the first guide member and the second guide member, and the printing medium supplied from the second printing medium supply device passes under the second guide member.

In accordance with another aspect of the present disclosure, an image forming apparatus includes a main body, a first printing medium supply device and a second printing medium supply device which supply a printing medium to the inside of the main body, a feeding roller device disposed inside the main body to deliver the printing medium supplied from the first printing medium supply device and the second printing medium supply device, and a guide unit disposed to guide the printing medium supplied to the feeding roller device, wherein the guide unit includes a first guide member and a second guide member which are rotatable to access the printing medium inside the main body when the printing medium is jammed, and the first guide member is rotated independently from the second guide member.

The second guide member may be configured to be rotated along with the first guide member after the first guide member is rotated at a predetermined angle with respect to the second guide member The first guide member may be rotatably coupled to the second guide member.

The feeding roller device may include a first feeding roller having a rotating shaft, and the second guide member may be rotatably coupled to the rotating shaft.

The first feeding roller may be moveable in a direction perpendicular to an axial direction of the first feeding roller in association with the rotation of the guide unit.

The guide unit may further include an elastic member which elastically supports at the first guide member and the second guide member.

The guide unit may further include an elastic member which elastically supports at the feeding roller device and the second guide member.

The guide unit may further include a protrusion which is provided on one of the first and second guide members, and interferes with the other of the first and second guide members according to the rotation of the first guide member In accordance with an aspect of the present disclosure, an image forming apparatus include a developing device, a first feeding and delivering path through which a printing medium is delivered to the developing device, and a second feeding and delivering path partitioned from the first feeding and delivering path, a feeding roller device which delivers the printing medium from the first and second feeding and delivering paths to the developing device, and a guide unit, which guides the printing medium delivered to the feeding roller device through the first and second feeding and delivering paths, having a first guide member rotatable from a guide position to an open position to access the first feeding and delivering path, and a second guide member coupled to the first guide member and rotated according to the first guide member.

An image forming apparatus according to the present disclosure includes a developing device which forms an image on a printing medium, a plurality of feeding and delivering paths through which a printing medium is delivered to the developing device, a feeding roller unit which forms a developing and delivering path in which the plurality of feeding and delivering paths are joined and delivers the printing medium to the developing device, and a guide unit which guides the printing medium passing through the plurality of feeding and delivering paths to the feeding roller unit and is rotatably provided to expose the plurality of feeding and delivering paths to the outside.

The guide unit may include a plurality of guide members configured to form at least some portion of each of the plurality of feeding and delivering paths.

The plurality of feeding and delivering paths may include a first feeding and delivering path, a second feeding and delivering path separated from the first feeding and delivering path. The guide unit may include a first guide member which forms one side surface of the first feeding and delivering path in at least some section thereof, and a second guide member which forms one side surface of the second feeding and delivering path in at least some section thereof.

The first feeding and delivering path may be a path in which the printing medium supplied from a first printing medium supply device, which is manually fed, is delivered and the second feeding and delivering path may be a path in which the printing medium supplied from the second printing medium supply device, which is automatically fed, is delivered.

The plurality of guide members may be configured to be rotated together.

The guide unit may further include a coupling part provided to allow the plurality of guide members to be separated at a certain angle to be coupled.

The guide unit may be moved to a guide position in which the plurality of guide members form one side surface of the plurality of feeding and delivering paths in at least some section thereof, and an open position to which the guide unit is rotated from the guide position to expose the plurality of feeding and delivering paths to the outside.

The guide unit may further include a unit elastic member to be connected to any one among the plurality of guide members and to generate an elastic force so that the guide unit is elastically returned from the open position to the guide position.

The guide unit may further include a guide rotating part which is formed to extend to the feeding roller device and rotatably supports the plurality of guide members so that the guide unit is rotated around the feeding roller device The first guide member and the second guide member may be configured to be sequentially moved and rotated.

The guide unit may be configured to be moved to a guide position in which the first guide member and the second guide member form one side surface of each of the first feeding and delivering path and the second feeding and delivering path in at least some section thereof, a first open position to which the first guide member is rotatably moved from the guide position to expose the first feeding and delivering path to the outside, and a second open position to which the second guide member is rotatably moved from the first open position to expose the second feeding and delivering path to the outside.

The guide unit may further a unit elastic member which elastically supports the guide unit to be elastically returned from the first open position or the second open position.

The guide unit may further include a roller bracket which supports the feeding roller device. The unit elastic member may include a first elastic member to generate an elastic force between the first guide member and the second guide member to allow the first guide member to be elastically returned, and a second elastic member to generate an elastic force between the roller bracket and the second guide member to allow the second guide member to be elastically returned.

The guide unit may include a movement limiting part to restrict the movement of the first guide member with respect to the second guide member.

The movement limiting part may include a movement protrusion provided in any one of the first guide member and the second guide member, and a movement rail provided in the other of the first guide member and the second guide member so that the movement protrusion is moved within a restricted interval.

The feeding roller device may include a first feeding roller, a second feeding roller facing the first feeding roller so that the printing medium passes through, and a roller bracket which rotatably supports the first feeding roller and the second feeding roller and is movable in a direction in which the first feeding roller is separated from the second feeding roller in association with the movement of the guide unit.

The feeding roller device may be configured to allow the first feeding roller to become separated from the second feeding roller when the guide unit is moved from the guide position to the open position.

The roller bracket may include a contact position in which the first feeding roller and the second feeding roller contact each other to allow the printing medium to pass therebetween, and a roller rail formed to move to a separated position separated from the contact position.

The roller bracket may include a lifting guide part provided to allow the guide unit to contact the roller bracket and move and formed in a long shape in a direction of the roller rail so that the first feeding roller is positioned at the contact position when the guide unit is positioned at the guide position and the first feeding roller is positioned at the separated position when the guide unit is positioned at the open position.

The feeding roller device may further include a pressing elastic member which presses the first feeding roller from the contact position to the separated position.

The feeding roller device may be configured to align the printing medium moved through the plurality of feeding and delivering paths, and to move the printing medium to the developing and delivering path.

The guide unit may further include a handle part provided for manipulation.

In accordance with yet another aspect of the present disclosure, an image forming apparatus includes a developing device, a first feeding and delivering path through which a printing medium is delivered to the developing device and a second feeding and delivering path partitioned from the first feeding and delivering path, a feeding roller device which forms the developing and delivering path in which the first and second feeding and delivering paths are merged and delivers the printing medium to the developing device, a feeding partition unit which partitions the first feeding and delivering path from the second feeding and delivering path and is provided to form an opening between the feeding roller device and the feeding partition unit, and a guide unit, which guides the printing medium delivered to the feeding roller device through the first and second feeding and delivering paths, is moved between a guide position where the guide unit is positioned at the opening and guides the printing medium delivered to the feeding roller device to an open position where the opening is opened.

The second feeding and delivering path may be provided under the first feeding and delivering path.

The guide unit may include a guide member disposed at the opening and provided to allow the opening to be opened and closed.

The guide unit may further a guide rotating part formed to extend from the guide member to be moved between the guide position to the open position, and rotatably provided with respect to the feeding roller device.

The feeding partition unit may include a first delivering partition member which is formed above the first feeding and delivering path, a second delivering partition member formed between the first feeding and delivering path and the second feeding and delivering path. The opening may include a first opening formed between the first delivering partition member and the feeding roller device, and a second opening formed between the second delivering partition member and the feeding roller device. The guide unit may include a first guide member rotatably provided to open and close the first opening, and a second guide member rotatably provided to open and close the second opening.

The first guide member and the second guide member may be provided rotatable together when the guide unit is moved from the guide position to the open position.

The first guide member and the second guide member may be provided sequentially rotatable when the guide unit is moved from the guide position to the open position.

The guide unit may further include a unit elastic member which is connected to any one of the first guide member and the second guide member and generates an elastic force so that the guide unit is elastically returned from the open position to the guide position.

In accordance with yet another aspect of the present disclosure, an image forming apparatus includes a developing device, a plurality of printing medium supply devices which supply a printing medium to the developing device through a feeding and delivering path, a feeding roller device which delivers the printing medium supplied through the feeding and delivering path to the developing device, and a guide unit, which guides the printing medium supplied from the plurality of printing medium supply devices to the feeding roller device and is rotatably provided in the feeding roller device, is upwardly rotated from a guide position in which the printing medium is guided to be delivered and is provided to be movable to an open position in which the feeding and delivering path is opened.

BRIEF DESCRIPTION OF THE DRAWINGS

These and/or other aspects of the disclosure will become apparent and more readily appreciated from the following description of the embodiments, taken in conjunction with the accompanying drawings of which.

DESCRIPTION OF EMBODIMENTS

Figure 1:
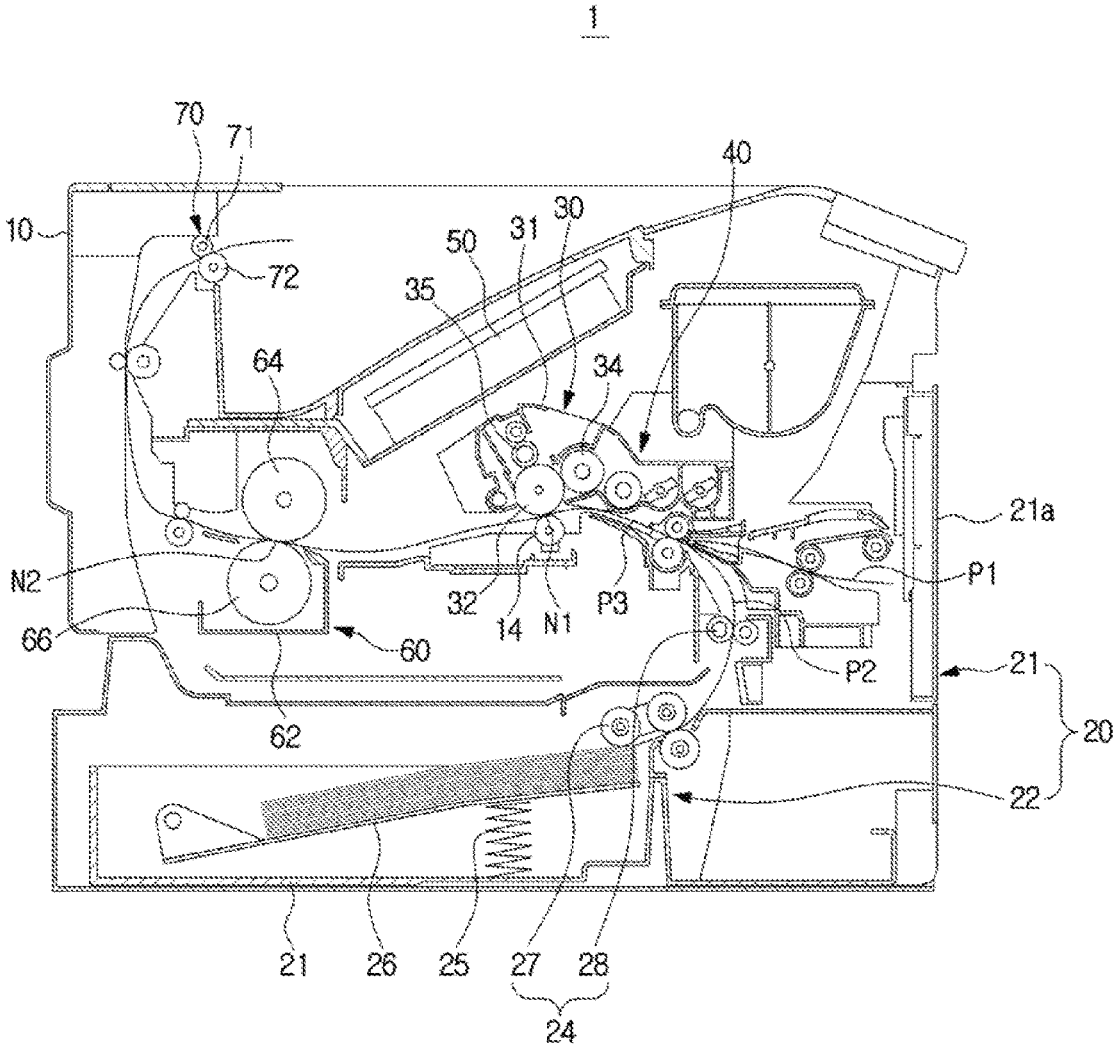
FIG. 1 is a cross-sectional view of an image forming apparatus according to one embodiment of the present disclosure.

The embodiments described in this specification and configurations illustrated in drawings are only exemplary embodiments and do not represent the overall technological scope of the disclosure, and it is to be understood that the disclosure covers various equivalents, modifications, and substitutions at the time of filing of this application.

Also, throughout the entire specification, the same reference numerals refer to the same components or elements to serve the same function Also, the terminology used herein is for the purpose of describing particular embodiments only and is not intended to be limiting of the present disclosure. Also, as used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Also, it will be understood that, although the terms including ordinal numbers such as "first," "second," etc. may be used herein to describe various elements, these elements are not limited by these terms. These terms are only used to distinguish one element from another. For example, a second element could be termed a first element without departing from the teachings of the present disclosure, and similarly a first element could be also termed a second element. The term "and/or" includes any and all combinations of one or more of the associated, listed items.

Hereinafter, embodiments of the present disclosure will be described more fully with reference to the accompanying drawings.

FIG. 1 is a cross-sectional view of an image forming apparatus according to one embodiment of the present disclosure.

As illustrated in FIG. 1, an image forming apparatus 1 may include a main body 10, a printing medium supply device 20 for storing and delivering a printing medium S, a developing device 30 which forms an image on the printing medium S delivered through the printing medium supply device 20, a toner device 40 which supplies the developing device 30 with toner, an optical scanning device 50 which forms an electrostatic latent image on a photoreceptor 32 of the developing device 30, a fixing device 60 which fixes the transferred toner image on the printing medium S, and an ejecting device 70 which ejects the printing medium S on which an image is completely formed to the outside of the main body 10.

The printing medium supply device 20 serves to store and supply the printing medium and is provided in a lower portion of the main body 10 to supply the printing medium toward the developing device 30.

The printing medium supply device 20 may include a first printing medium supply device 21 which is a multi-purpose (MP) type and manually supplies the printing medium, a second printing medium supply device 22 which is a cassette type and automatically supplies the printing medium. The first printing medium supply device and the second printing medium supply device may be provided at different positions in the main body 10.

The first printing medium supply device 21 may include a supply door 21*a* rotatably provided in one side of the main body 10 and the supply door 21*a* may be opened to load the printing medium. A delivering path of the printing medium supplied from the first printing medium supply device 21 may be referred to as a first feeding and delivering path P1.

The second printing medium supply device 22 may include a printing medium cassette coupled to the main body 10 to be opened or closed so as to store the printing medium, and include a feeding member 24 which picks up the printing medium S stored in the printing medium cassette one by one and delivers the picked printing medium to the developing device 30.

In the printing medium cassette, a knock-up plate 26 may be provided to have one end rotatably coupled to guide the loaded printing medium S toward the feeding member 24 and the other end supported by a pressing spring 25.

The feeding member 24 may include a pick-up roller 27 which picks up one sheet of the printing medium S stacked on the knock-up plate 26 at a time, and a feeding roller 28 which delivers the printing medium S picked by the pick-up roller 27 to the developing device 30.

A feeding path, through which a printing medium is supplied from the second printing medium supply device 22, is referred to as the second feeding and delivering path P2. A first feeding and delivering path P1 and the second feeding and delivering path P2 may be formed to be separated from each other.

The image forming apparatus 1 may include a delivering partition unit 80 (see FIGS. 5 and 6) which is provided to partition a plurality of feeding and delivering paths P1 and P2. The delivering partition unit 80 is provided to partition the plurality of feeding and delivering paths P1 and P2 and prevents the interference between the supply of the printing media for the plurality of feeding and delivering paths P1 and P2. The delivering partition unit 80 is satisfied when the configuration thereof performs a function of partitioning the plurality of feeding and delivering paths P1 and P2.

The developing device 30 may include a housing 31 which forms an exterior, the photoreceptor 32 rotatably provided inside the housing 31, a developing roller 34 which supplies the photoreceptor 32 with toner, and a charging member 35 which charges the photoreceptor 32.

The toner supplied from the toner device 40 is supplied to the photoreceptor 32 by the developing roller 34 to form a visible image.

The photoreceptor 32 is in contact with a transfer roller 14 to form a transfer nip N1 so that the toner supplied to the photoreceptor 32 to form the visible image is transferred to the printing medium S. The transfer roller 14 is rotatably disposed inside the main body 10.

The toner device 40 is coupled with the developing device 30, accommodates and stores the toner to form a visible image on the printing medium S, and supplies the toner to the developing device 30 when an image forming operation is performed.

The optical scanning device 50 scans the photoreceptor 32 with light including information of an image to form an electrostatic latent image on the photoreceptor 32.

The fixing device 60 is constituted by including a housing 62, and a heating member 64 and a pressing member 66 which are rotatably disposed inside the housing 62.

When the printing medium S on which a toner image is transferred passes between the heating member 64 and the pressing member 66, the toner image is fixed on the printing medium S by heat and pressure.

The heating member 64 is interlocked and rotated with the pressing member 66, forms a fixing nip N2 with the pressing member 66, and is heated by a heat source (not shown) to transfer the heat to the printing medium S which passes through the fixing nip N2. The heating member 64 may be formed with a heating roller rotated by receiving driving power from a driving source (not shown). The heat source is disposed inside the heating member 64 to apply heat to the printing medium S on which the toner is transferred. A halogen lamp may be used for the heat source, but various types, such as an electrothermal wire and an induction heater, may also be applied.

The pressing member 66 is disposed to be in contact with an outer circumferential surface of the heating member 64 and the fixing nip N2 is formed between the pressing member 66 and the heating member 64. The pressing member 66 may be formed with a pressing roller rotated by receiving driving power from a driving source (not shown).

The ejecting device 70 includes a first ejecting roller 71 and a second ejecting roller 72 which are interlocked, and ejects the printing medium S which has passed through the fixing device 60 to the outside of the main body 10.

Figure 2:
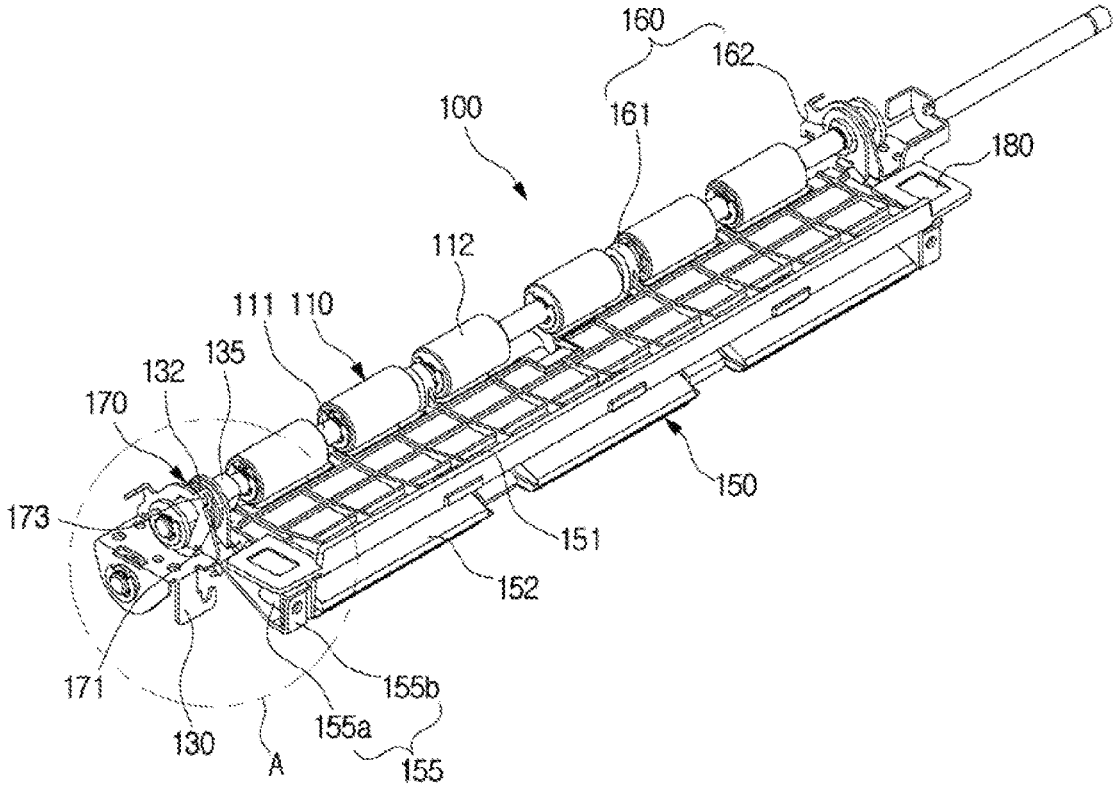
FIG. 2 is a perspective view of a guide unit and a feeding roller device in the image forming apparatus according to one embodiment of the present disclosure.

FIG. 2 is a perspective view of a guide unit and a feeding roller device in the image forming apparatus according to one embodiment of the present disclosure.

The printing medium supplied from first and second printing medium supply devices 21 and 22 is delivered to the developing device 30 through the first feeding and delivering path P1 or the second feeding and delivering path P2. In detail, the first feeding and delivering path P1 and the second feeding and delivering path P2 are merged at a developing and delivering path P3 to deliver the printing media to the developing device 30.

A feeding roller device 100 is provided to deliver the printing media delivered through the plurality of feeding and delivering paths P1 and P2 to the developing and delivering path P3. Further, the feeding roller device 100 is provided to align the printing media supplied through the plurality of feeding and delivering paths P1 and P2.

A guide unit 150 is provided to guide the printing media which have passed through the plurality of feeding and delivering paths P1 and P2 to the feeding roller device 100. The guide unit 150 is provided to expose the plurality of feeding and delivering paths P1 and P2 to the outside through a certain operation, and then, the printing medium may be easily removed when a printing medium jam occurs in a process of supplying the printing medium.

Hereinafter, the detailed operations and configurations of the feeding roller device 100 and the guide unit 150 will be described.

Figure 3:
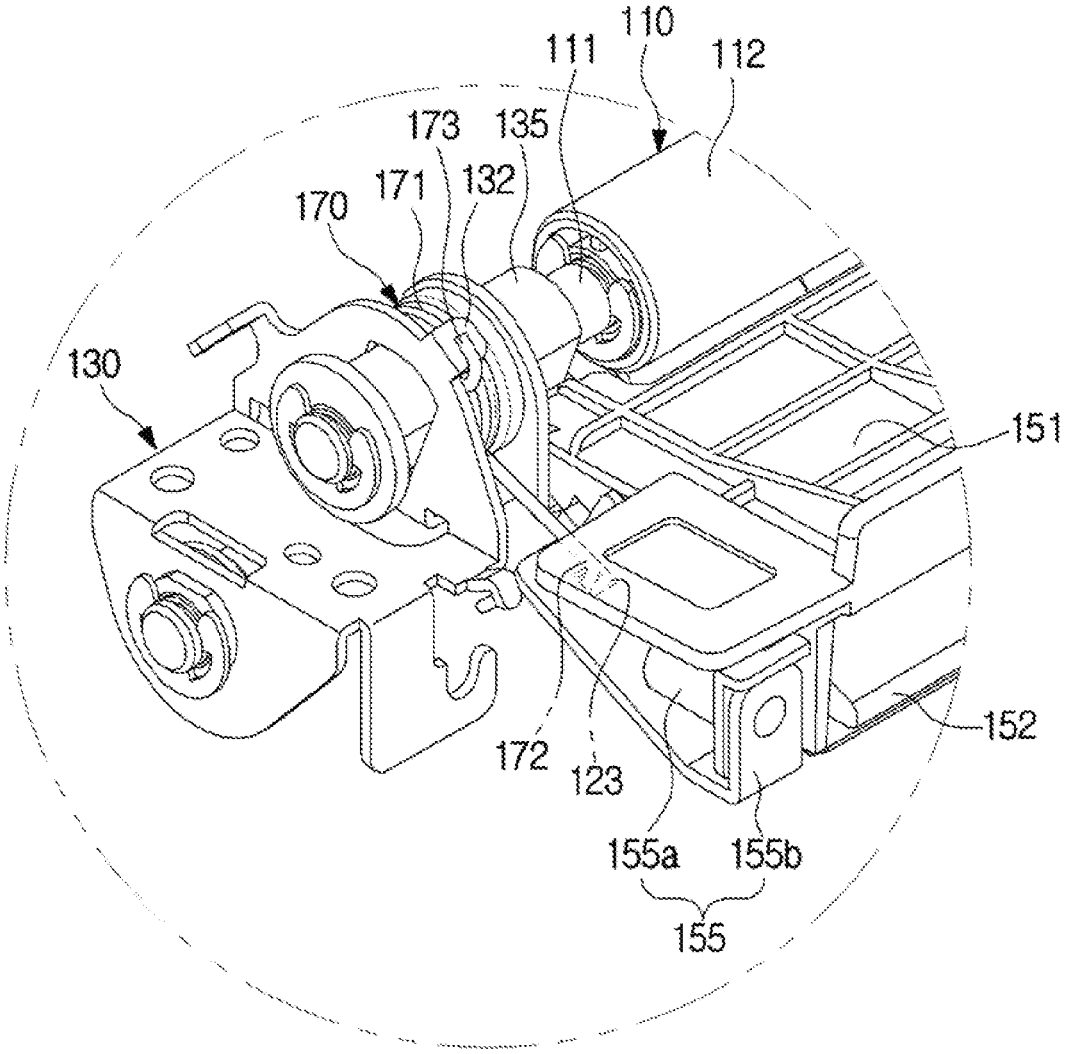
FIG. 3 is an enlarged view of a portion A in FIG. 2.
Figure 4:
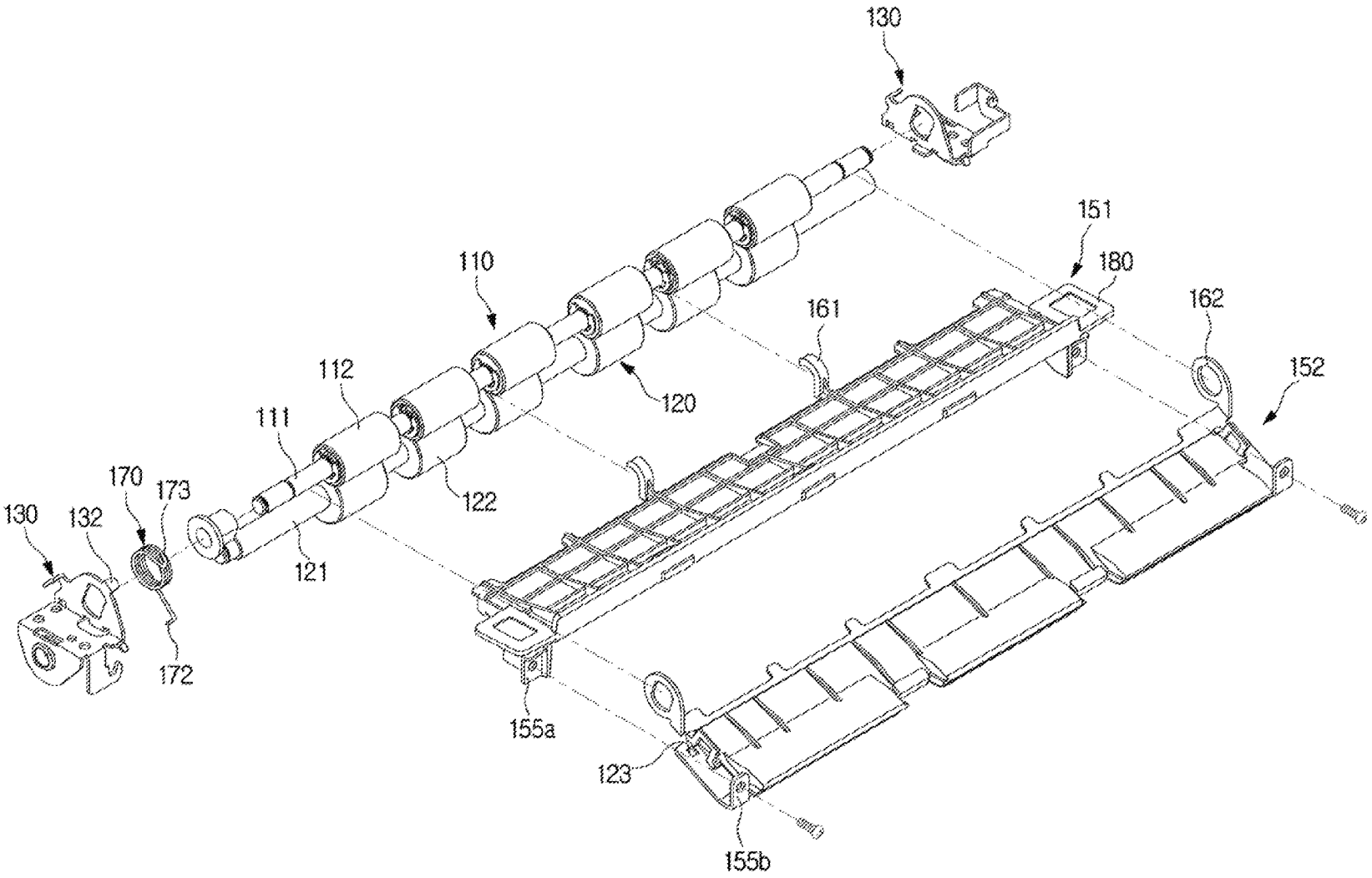
FIG. 4 is an exploded perspective view of FIG. 2.

FIG. 3 is an enlarged view of a portion A shown in FIG. 2, and FIG. 4 is an exploded perspective view of FIG. 2.

The feeding roller device 100 may be provided to form the developing and delivering path P3 through which the printing medium is delivered to the developing device 30. The feeding roller device 100 may be provided to merge the printing media supplied through the plurality of feeding and delivering paths P1 and P2 at the developing and delivering path P3 so as to deliver the printing media to the developing device 30. The feeding roller device 100 may be provided to align the printing media supplied through the plurality of feeding and delivering paths P1 and P2.

The feeding roller device 100 may include a first feeding roller 110 and a second feeding roller 120 provided to face the first feeding roller 110. The printing media delivered through the plurality of feeding and delivering paths P1 and P2 may be provided to pass between the first feeding roller 110 and the second feeding roller 120. That is, the feeding roller device 100 forms the developing and delivering path P3 using the first feeding roller 110 and the second feeding roller 120. Further, the printing media delivered through the plurality of feeding and delivering paths P1 and P2 are aligned by the first feeding roller 110 and the second feeding roller 120 before passing through between the first feeding roller 110 and the second feeding roller 120. Any one feeding roller of the first feeding roller 110 and the second feeding roller 120 is provided to be rotated by receiving driving power from a driving source (not shown) and the other feeding roller is provided to be rotated by receiving rotating power by being in contact with the any one feeding roller.

The first feeding roller 110 may include a first rotating shaft 111 provided rotatably and a first roller 112 mounted on the first rotating shaft 111 to be in contact with the printing medium. Further, the second feeding roller 120 may include a second rotating shaft 121 provided rotatably and a second roller 122 mounted on the second rotating shaft 121 to be in contact with the printing medium.

The feeding roller device 100 may include a roller bracket 130.

The roller bracket 130 is provided to rotatably support both ends of the first feeding roller 110 and the second feeding roller 120 so that the first feeding roller 110 and the second feeding roller 120 are rotatable. The roller bracket 130 is provided to support the rotation of feeding rollers and to be fixed in the main body.

The guide unit 150 is provided to guide the printing medium which has passed through at least one of the feeding and delivering paths P1 and P2. In the embodiment of the present disclosure, the plurality of feeding and delivering paths P1 and P2 are provided as an example. Even when one feeding and delivering path is provided, the guide unit 150 of the present disclosure may be applied. The guide unit 150 may form one side surface of the feeding and delivering paths P1 and P2 in at least a part of section thereof. That is, when the guide unit 150 is positioned at a certain position, the guide unit 150 may form a part of section of the feeding and delivering paths to guide the printing medium to be delivered.

The guide unit 150 may include at least one of guide members 151 and 152. When a printing medium jam occurs, the at least one of guide members 151 and 152 may be rotated to access the printing medium in the main body 10. The at least one of the guide members 151 and 152 may be provided to be rotated together with the other. Here, the guide members 151 and 152 may be rotated in the same direction.

The guide members 151 and 152 may be configured to form at least a portion of the feeding and delivering paths. In detail, the guide unit 150 may include a first guide member 151 which forms one side surface of the first feeding and delivering path P1 in at least a part of section thereof and a second guide member 152 which forms one side surface of the second feeding and delivering path P2 in at least a part of section thereof. In the embodiment of the present disclosure, the plurality of feeding and delivering paths P1 and P2 and the plurality of guide members, for convenience of description, are respectively exemplified by the first and second feeding and delivering paths P1 and P2 and the first and second guide members 151 and 152, but the number of the feeding and delivering paths and the guide members are not limited thereto.

The first and second guide members 151 and 152 may be provided at one side of the first and second feeding and delivering paths P1 and P2, respectively, and may form portions of the first and second feeding and delivering paths P1 and P2. The first and second guide members 151 and 152, as described below, may form portions of the first and second feeding and delivering paths P1 and P2, and may be provided to expose portions of the first and second feeding and delivering paths P1 and P2 to the outside by moving the first and second guide members 151 and 152.

The first and second guide members 151 and 152 may be separated from each other. In the above configuration, the first feeding and delivering path P1 may be formed between the first and second guide members 151 and 152, and the second feeding and delivering path P2 may be formed under the second guide member 152.

A plurality of guide members 151 and 152 are provided to be rotated together to simultaneously expose the plurality of feeding and delivering paths P1 and P2 to the outside. To this end, the guide unit 150 may include a coupling part 155 which mutually connects or couples the plurality of guide members 151 and 152. The second guide member 152 may be fixed to the first guide member 151 through the coupling part 155.

The coupling part 155 may include a first coupling member 155*a* extending from the first guide member 151, and a second coupling member 155*b* extending from the second guide member 152. The first coupling member 155*a* and the second coupling member 155*b* may be coupled by screw-coupling. The method of connecting the first guide member 151 and the second guide member 152 is not limited thereto. As an example, the first and second guide members 151 and 152 may be formed integrally.

The guide unit 150 may include a guide rotating part 160 provided so that the plurality of guide members 151 and 152 are rotatable. The guide rotating part 160 may be provided so that the plurality of guide members 151 and 152 are rotated around the feeding roller device 100. In the embodiment, the plurality of guide members 151 and 152 are provided at the first feeding roller 110 to be rotatably supported.

The guide rotating part 160 extends from at least one guide member of the plurality of guide members 151 and 152 to the feeding roller device 100 and provided to rotatably support the plurality of guide members. In the embodiment, the guide rotating part 160 may include a first rotating part 161 formed at the first guide member 151 and a second rotating part 162 formed at the second guide member 152. The first and second rotating parts 161 and 162 may extend from the first and second guide members 151 and 152, respectively, and be formed to surround the first rotating shaft 111 of the first feeding roller 110. The first and second rotating parts 161 and 162 may be separated and disposed in a longitudinal direction of the feeding roller device 100 so as not to interfere with each other.

In detail, the first rotating part 161 may be rotatably provided with respect to the first rotating shaft 111 at the center of the first rotating shaft 111 of the first feeding roller 110. The second rotating part 162 may be rotatably provided with respect to the first rotating shaft 111 at both ends of the first rotating shaft 111 of the first feeding roller 110. However, positions of the rotating parts are not limited to the above and any positions thereof which are disposed without mutual interference are available.

The guide rotating part 160 is rotatably provided irrespective of the rotation of the rotating shaft. Therefore, the rotating parts may cause friction with a roller which delivers the printing medium and is rotated together with the rotating shaft. To prevent this friction, the feeding roller device 100 may include a bushing member 135 provided between the guide rotating part 160 and rollers. The bushing member 135 may be disposed between the rollers and the guide rotating part 160 to prevent friction which occurs by contacting the rollers and the guide rotating part 160.

The guide unit 150 may be rotatably provided between a guide position 150*a* and an open position 150*b* with respect to the feeding roller device 100. In detail, the guide unit 150 may be provided to be upwardly moved from the guide position 150*a* where the printing medium delivered is guided to the open position 150*b* where the feeding and delivering paths P1 and P2 are opened.

The guide position 150*a* is a position where the plurality of guide members form one side surface of each of the plurality of feeding and delivering paths P1 and P2 in at least a part of section thereof. The open position 150*b* is a position where the plurality of feeding and delivering paths P1 and P2 are exposed to the outside. In the embodiment, the open position 150*b* may be a position to which the guide unit 150 is upwardly moved from the guide position 150*a*.

The guide unit 150 may include a unit elastic member 170.

The unit elastic member 170 is provided to elastically return the guide unit 150 from the open position 150*b* to the guide position 150*a*. The body of the unit elastic member 170 is installed on the feeding roller device 100 and one end of the unit elastic member 170 is configured to support the guide unit 150, so that an elastic force occurs according to the operation of the guide unit 150.

In the embodiment, a body 171 of the unit elastic member 170 is provided for the first rotating shaft 111 to pass through the inside of the body 171, one end 172 of the body 171 is provided to be supported by the second guide member 152 and the other end 173 is provided to be supported by the roller bracket 130. A mounting groove 123 in which the one end 172 of the unit elastic member 170 is mounted may be formed on the second guide member 152 to support the one end 172 of the unit elastic member 170. Further, a hook protrusion 132 which protrudes toward the unit elastic member 170 is formed on the roller bracket 130 to support the other end 173 of the unit elastic member 170. In the above configuration, the guide unit 150 may be elastically returned from the open position 150*b* to the guide position 150*a* by the unit elastic member 170. The position and shape of the unit elastic member 170 are not limited, and any configuration for elastically returning the guide unit 150 is available. As an example, the unit elastic member 170 may be provided for the second rotating shaft 121 to pass through the inside thereof and one end of the unit elastic member 170 may be supported by the first guide member 151.

The guide unit 150 may include a handle part 180.

As described above, the printing medium jam problems may occur in a process of delivering the printing medium to the developing device 30. Here, the guide unit 150 should be moved from the guide position 150*a* to the open position 150*b* by an external force. The handle part 180 may be formed to extend from any one of the guide members, and a user may grip the handle part 180 and rotate the guide unit 150. In the embodiment, the handle part 180 may be formed to extend from the first guide member 151.

The guide unit 150 and the guide member will be described again from a different perspective.

Figure 5:
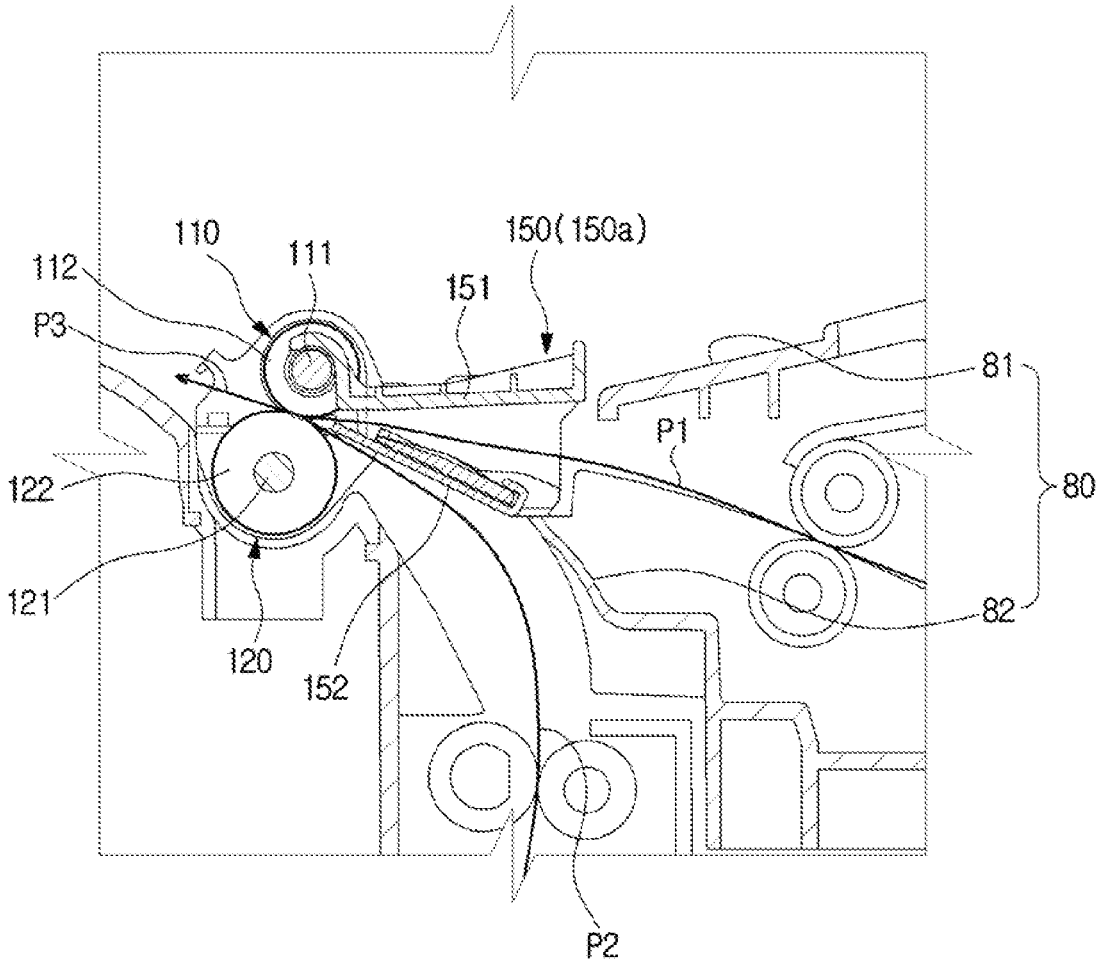
FIGS. 5 and 6 are views for an operation of the guide unit and the feeding roller device in the image forming apparatus according to one embodiment of the present disclosure.

The first feeding and delivering path P1 and the second feeding and delivering path P2 may be provided to be partitioned by at least one delivering partition unit 80 (see FIG. 5). The delivering partition unit 80 may include a first delivering partition member 81 formed above the first feeding and delivering path P1 and a second delivering partition member 82 formed between the first feeding and delivering path P1 and the second feeding and delivering path P2.

The delivering partition unit 80 may be provided to form opening parts 81*a* and 82*a* (see FIG. 6) between the feeding roller device 100 and the delivering partition unit 80. In detail, the opening parts 81*a* and 82*a* may include a first opening 81*a* formed between the first delivering partition member 81 and the feeding roller device 100, and a second opening 82*a* formed between the second delivering partition member 82 and the feeding roller device 100.

The guide unit 150 may include the first guide member 151 and the second guide member 152. The first guide member 151 may be rotatably provided to open and close the first opening 81*a*, and the second guide member 152 may be rotatably provided to open and close the second opening 82*a*.

That is, the guide unit 150 may be positioned to be disposed at the opening parts 81*a* and 82*a* to guide the printing medium delivered to the feeding roller device 100, and to open the opening parts 81*a* and 82*a* to expose the plurality of feeding and delivering paths P1 and P2 to the outside. In detail, when the guide unit 150 is positioned at the guide position 150*a*, the first guide member 151 and the second guide member 152 are respectively disposed at the first opening 81*a* and the second opening 82*a*, and when the guide unit 150 is positioned at the open position 150*b*, the first guide member 151 and the second guide member 152 respectively open the first opening 81*a* and the second opening 82*a*. Thus, the guide unit 150 opens and closes the opening parts 81*a* and 82*a*, and the plurality of feeding and delivering paths P1 and P2 may be selectively exposed to the outside.

The guide unit 150 is disposed at the opening parts 81*a* and 82*a* formed between delivering partition members 81 and 82 and the feeding roller device 100, and the guide unit 150 may be moved from the guide position 150*a*, where the printing medium delivered to the feeding roller device 100 is guided, to the open position 150*b* where the opening opens. Since the feeding and delivering paths may be exposed to the outside by this operation of the guide unit 150, the printing medium jam problems may be easily cleared.

Hereinafter, an operation of an image forming apparatus according to one embodiment of the present disclosure will be described.

Figure 6:
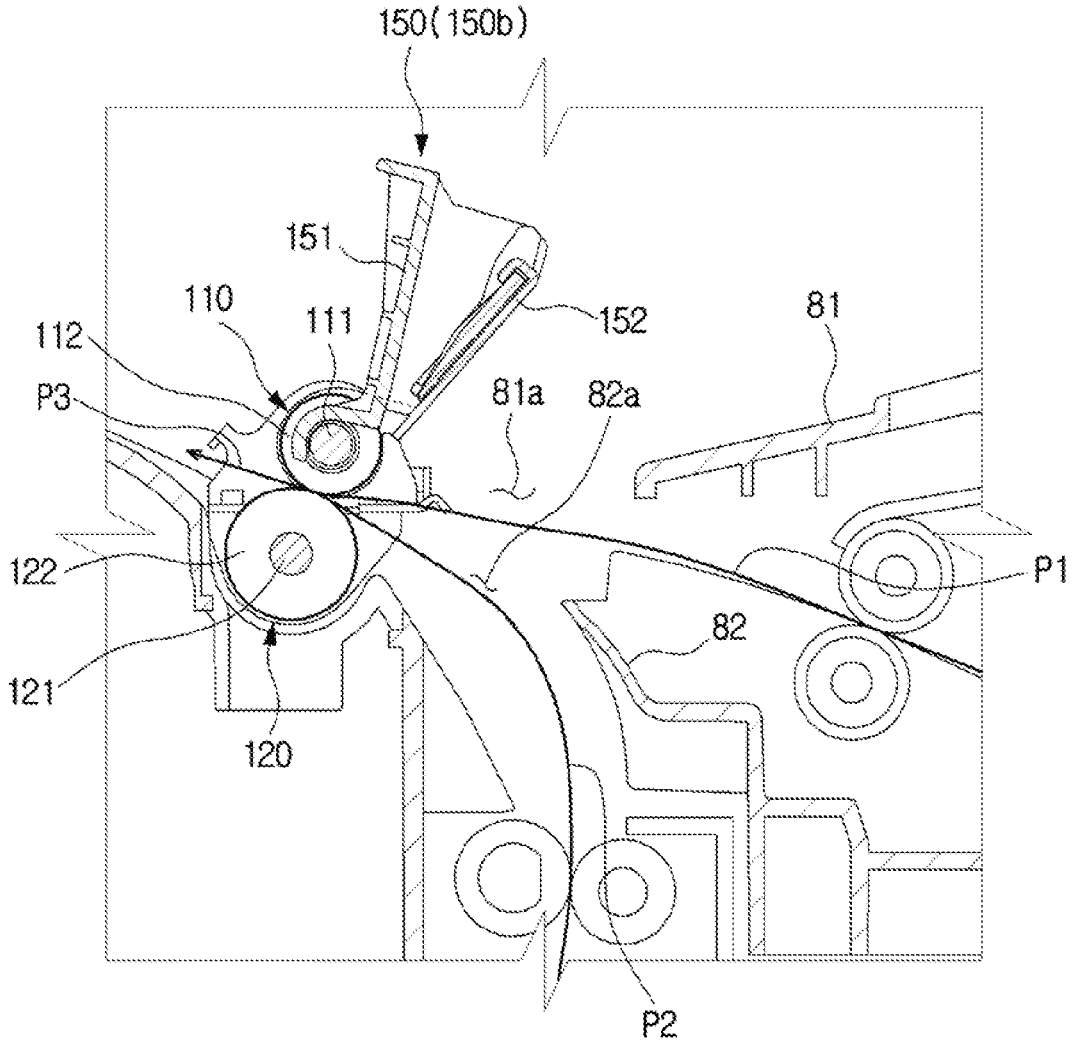

FIGS. 5 and 6 are views for an operation of the guide unit and the feeding roller device in the image forming apparatus according to one embodiment of the present disclosure.

When the guide unit 150 is positioned at the guide position 150*a*, the printing media are able to be delivered through the first feeding and delivering path P1 and the second feeding and delivering path P2. That is, the printing medium supplied from the first printing medium supply device 21 by the first guide member 151 is provided to be guided to the feeding roller device 100, and the printing medium supplied from the second printing medium supply device 22 by the second guide member 152 is provided to be guided to the feeding roller device 100.

In a process of forming an image on the printing medium, when the printing medium is jammed inside the image forming apparatus, a process of removing the jammed printing medium will be described.

When the printing medium is supplied from the first printing medium supply device 21 or the second printing medium supply device 22 and jammed inside the image forming apparatus 1, the guide unit 150 is upwardly rotated from the guide position 150*a*, and thus, the guide unit 150 is moved to the open position 150*b*. When the guide unit 150 is positioned at the open position 150*b*, the first feeding and delivering path P1 and the second feeding and delivering path P2 are exposed to the outside and are in an open state, and therefore, the printing medium jammed thereinside is easily removed. That is, when the guide unit 150 is positioned at the open position 150*b*, the first opening 81*a* and the second opening 82*a* are in the open state, the first feeding and delivering path P1 and the second feeding and delivering path P2 is exposed to the outside, and the printing medium thereinside is easily removed.

Further, when the printing medium is removed and an external force on the guide unit 150 is released, the guide unit 150 is elastically returned to the guide position 150*a* from the open position 150*b* by the unit elastic member 170.

Hereinafter, another embodiment of the present disclosure will be described.

Descriptions of configurations the same as described above will be omitted.

Figure 7:
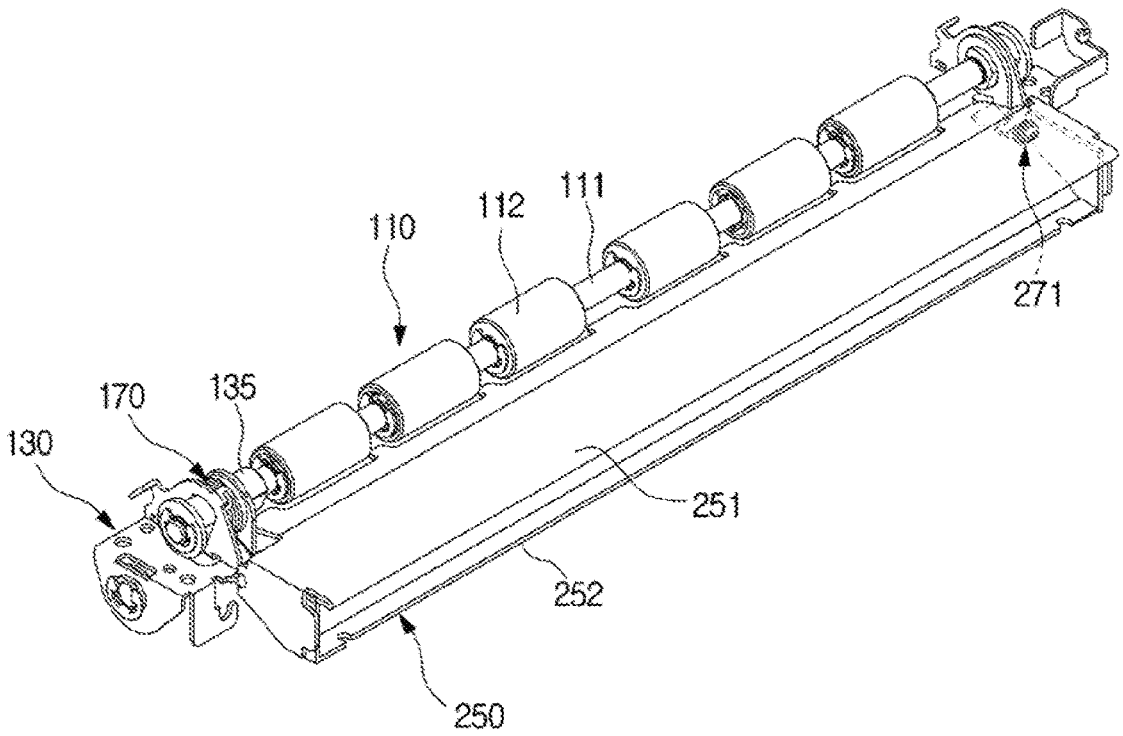
FIG. 7 is a perspective view of a guide unit and a feeding roller device in an image forming apparatus according to another embodiment of the present disclosure.
Figure 8:
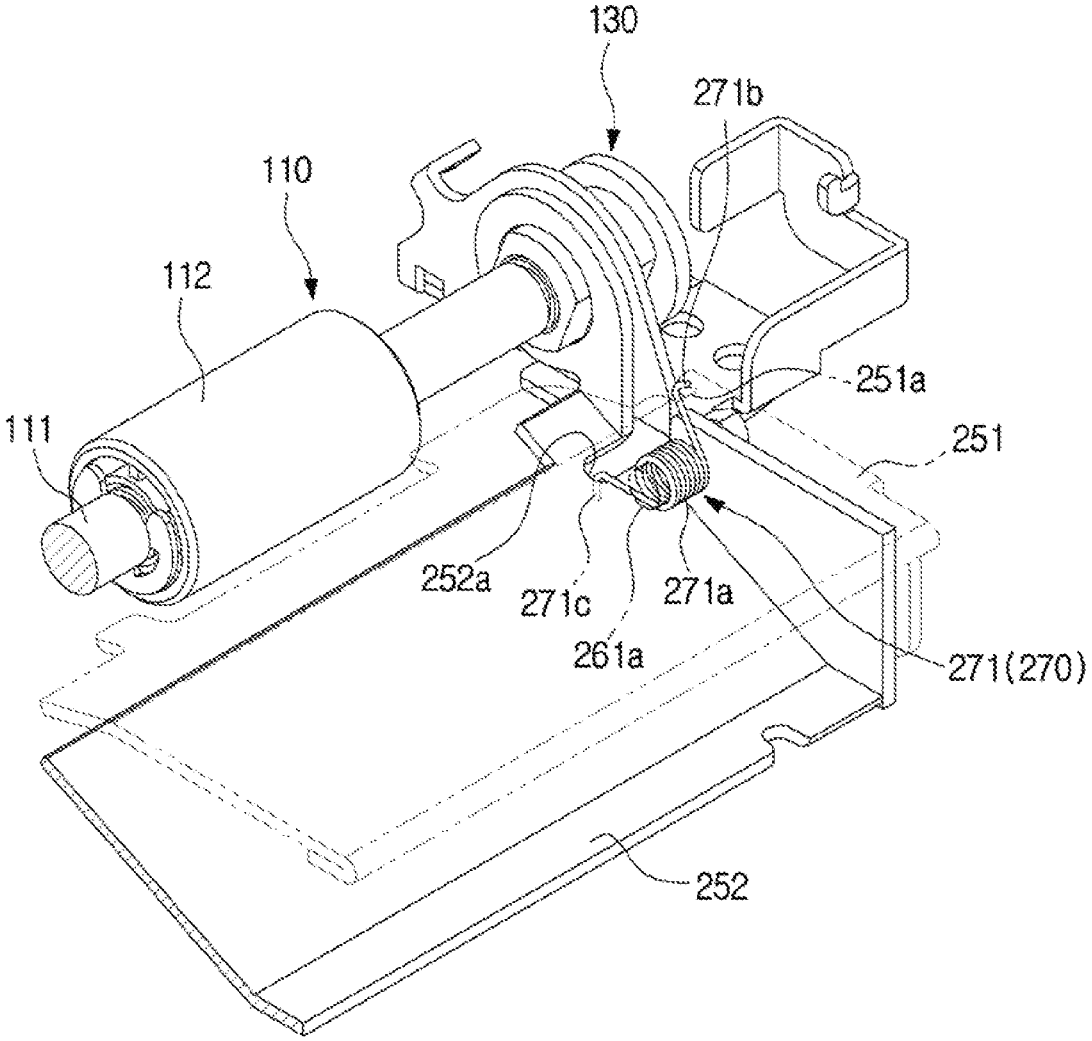
FIG. 8 is an enlarged view of a portion of FIG. 7.

FIG. 7 is a perspective view of a guide unit and a feeding roller device in an image forming apparatus according to another embodiment of the present disclosure, and FIG. 8 is an enlarged view of a portion of FIG. 7.

A guide unit 250 may include a first guide member 251 and a second guide member 252.

The guide unit 250 may include a guide rotating part 260 provided to rotate the first guide member 251 and the second guide member 252.

The guide rotating part 260 may include a first rotating part 261 provided to rotate the first guide member 251 with respect to the second guide member 252, and a second rotating part 162 provided to rotate the second guide member 252 with respect to the feeding roller device 100. The second rotating part 162 has the same configuration as the second rotating part 162 of the embodiment in FIGS. 2 and 4.

The first rotating part 261 may be provided to rotate the first guide member 251 with respect to the second guide member 252. The first guide member 251 may be rotatably coupled to the second guide member 252. In detail, the first rotating part 261 may include a rotating protrusion 261*a* formed on any one guide member of the first guide member 251 and the second guide member 252, and a rotating groove (not shown), which is formed in the other guide member, into which the rotating protrusion 261*a* is rotatably inserted. In the embodiment, the rotating protrusion 261*a* is provided at the first guide member 251 and the rotating groove is provided in the second guide member 252. The rotating protrusion 261*a* is inserted into the rotating groove and rotated, and the first guide member 251 is rotatably provided with respect to the second guide member 252.

A plurality of guide members 251 and 252 of the guide unit 250 are provided to be sequentially rotated and moved. The first guide member 251 may be rotated independently from the second guide member 252. The guide unit 250 may be provided to be moved to a guide position 250*a*, a first open position 250*b*, and a second open position 250*c*.

The guide position 250*a* is a position where the first guide member 251 and the second guide member 252 form one side surface of each of the first feeding and delivering path P1 and the second feeding and delivering path P2 in at least a part of section thereof. That is, the guide position 250*a* is a position where the first guide member 251 and the second guide member 252 are respectively disposed at the first opening 81*a* (see FIG. 10) and the second opening 82*a* (see FIG. 11), and close the first opening 81*a* and the second opening 82*a*. When the guide unit 250 is positioned at the guide position 250*a*, the printing media may be delivered through the first and second feeding and delivering paths P1 and P2, and the guide unit 250 guides the printing media.

The first open position 250*b* is a position where the first guide member 251 is rotatably moved to expose the first feeding and delivering path P1 to the outside. That is, the first open position 250*b* is the position where the first guide member 251 is rotatably moved to open the first opening 81*a*.

The second open position 250*c* is a position where the second guide member 252 is rotatably moved to expose the second feeding and delivering path P2 to the outside. That is, the second open position 250*c* is the position where the second guide member 252 is rotatably moved to open the second opening 82*a*.

The guide unit 250 is moved to the first open position 250*b* by an external force on the guide position 250*a*, and when the external force is maintained, is moved from the first open position 250*b* to the second open position 250*c*.

The guide unit 250 may include a unit elastic member 270.

The unit elastic member 270 is provided for the guide unit 250 to be elastically returned from the first open position 250*b* or the second open position 250*c*.

The unit elastic member 270 may include a first elastic member 271 by which the first guide member 251 is elastically returned from the first open position 250*b*, and a second elastic member 170 by which the second guide member 252 is elastically returned from the second open position 250*c*. The second elastic member 170 has the same configuration as the unit elastic member 170 of the embodiment in FIGS. 2, 3, and 4.

A body 271*a* of the first elastic member 271 is provided to surround the rotating protrusion 261*a*, and one end 271*b* and the other end 271*c* of the body 271*a* are provided to be respectively supported on the first guide member 251 and the second guide member 252. In detail, the one end 271*b* of the first elastic member 271 is supported on a first supporting part 251*a* provided near the feeding roller device 100 in the first guide member 251, and the other end 271*c* of the first elastic member 271 is supported on a second supporting part 252*a* provided near the feeding roller device 100 in the second guide member 252.

In the above configuration, when the guide unit 250 is moved from the guide position 250*a* to the first open position 250*b* by applying an external force to the guide unit 250, an elastic force is generated in the first elastic member 271. Further, when the external force with respect to the guide unit 250 is released, the first guide member 251 is elastically returned by the elastic force generated in the first elastic member 271.

When the guide unit 250 is positioned at the first open position 250*b*, the elastic force of the first elastic member 271 is maximized, and when the external force is constantly applied to the first guide member 251, the elastic force of the first elastic member 271 is not changed and the second guide member 252 is rotatably moved. That is, the guide unit 250 is moved to the second open position 250*c*.

Hereinafter, an operation of an image forming apparatus according to the embodiment will be described.

Figure 9:
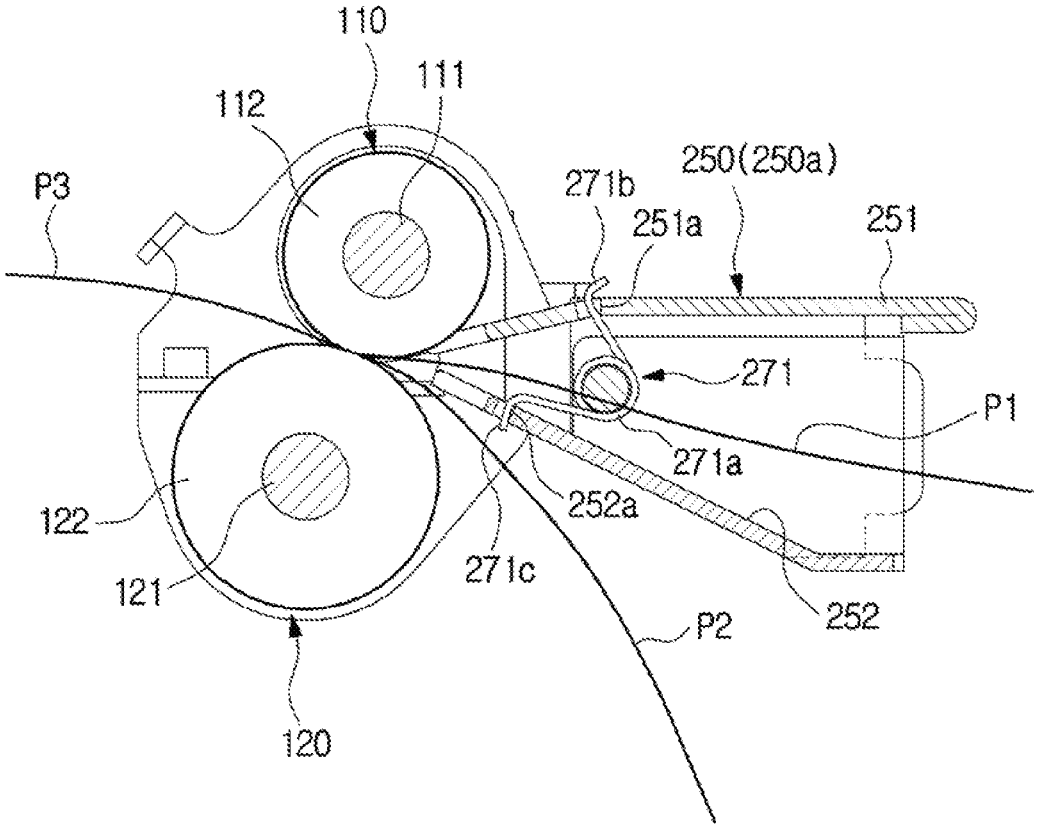
FIGS. 9, 10 and 11 are views for an operation of the guide unit and the feeding roller device illustrated in FIG. 7.
Figure 10:
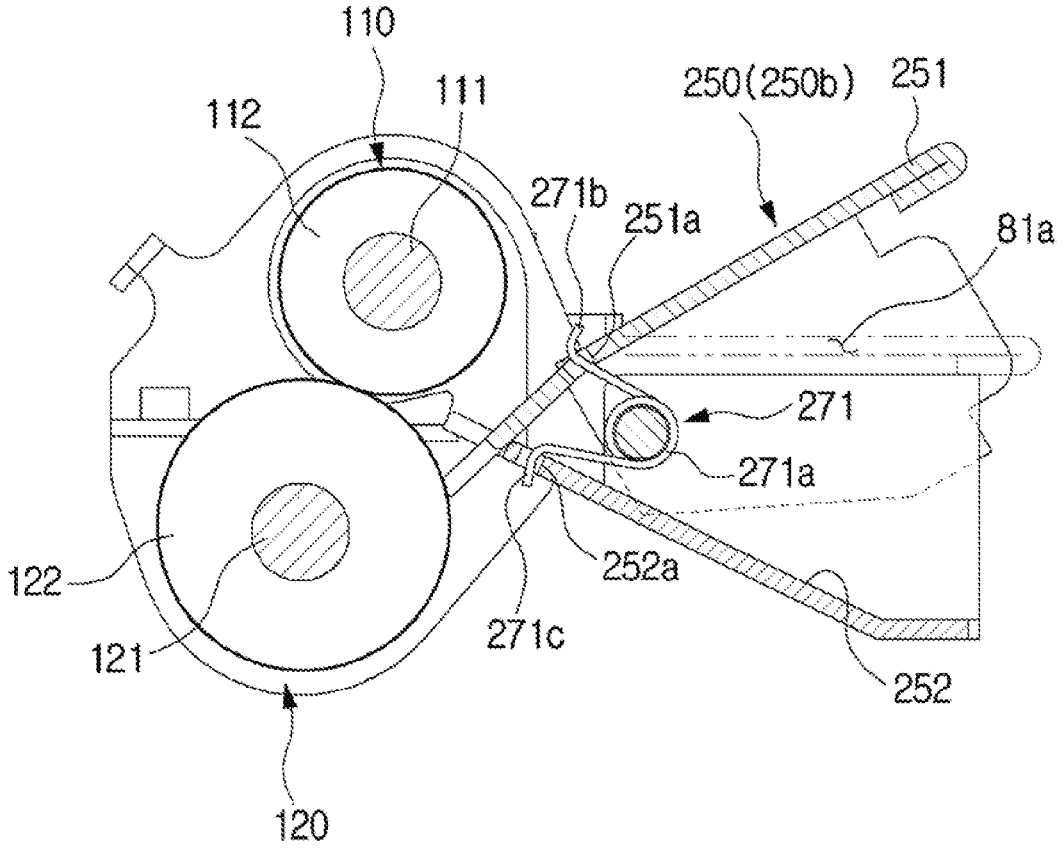
Figure 11:
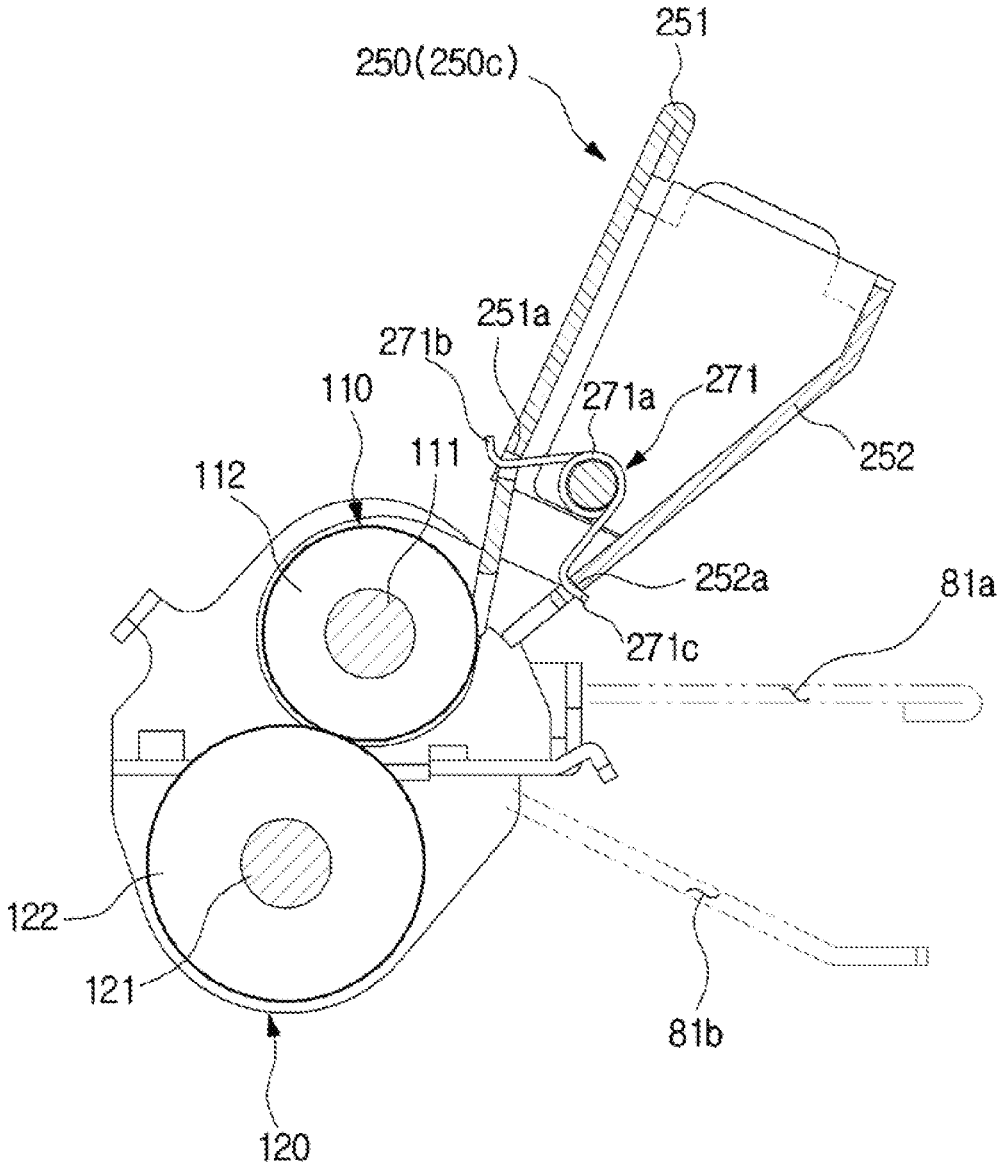

FIGS. 9, 10 and 11 are views for an operation of the guide unit and the feeding roller device illustrated in FIGS. 7 and 8.

When the guide unit 250 is positioned at the guide position 250*a*, the printing media are able to be delivered through the first feeding and delivering path P1 and the second feeding and delivering path P2. That is, the printing medium supplied from the first printing medium supply device by the first guide member 251 is provided to be guided to the feeding roller device 100, and the printing medium supplied from a second printing medium supply device by the second guide member 252 is provided to be guided to the feeding roller device 100.

In a process of forming an image on the printing medium, when the printing medium is jammed inside the image forming apparatus, a process of removing the jammed printing medium will be described.

When the printing medium is supplied through the first printing medium supply device or the second printing medium supply device and is jammed inside the image forming apparatus, the guide unit 250 is upwardly rotated from the guide position 250*a* and moved to the first open position 250*b* or the second open position 250*c*. That is, when the printing medium is jammed in the first feeding and delivering path P1, the guide unit 250 is moved to the first open position 250*b*, and when the printing medium is jammed in the second feeding and delivering path P2, the guide unit 250 is moved to the second open position 250*c*.

When the guide unit 250 is positioned at the first open position 250*b*, the first feeding and delivering path P1 is exposed to the outside, and when the guide unit 250 is positioned at the second open position 250*c*, the first and second feeding and delivering paths P1 and P2 are exposed to the outside. Therefore, the first and second feeding and delivering paths P1 and P2 are in an open state and the printing medium jammed thereinside may be easily removed.

That is, when the guide unit 250 is positioned at the first open position 250*b*, the first opening 81*a* is in the open state, and when the guide unit 250 is positioned at the second open position 250*c*, the first and second openings 81*a* and 81*b* are in the open state. Therefore, the first feeding and delivering path P1 and the second feeding and delivering path P2 are exposed to the outside and the printing medium thereinside may be easily removed.

Further, when an external force with respect to the guide unit 250 is released after the printing medium is removed, the guide unit 250 is elastically returned from the first open position 250*b* or the second open position 250*c* to the guide position 250*a* by the unit elastic member 270

Hereinafter, still another embodiment of the present disclosure will be described.

Descriptions of configurations the same as described above will be omitted.

Figure 12:
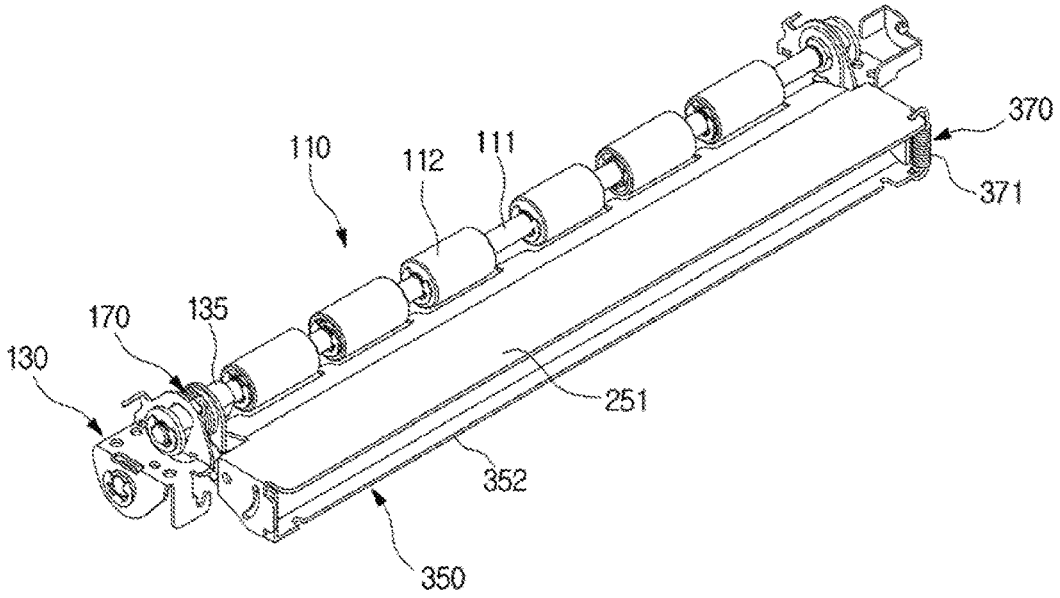
FIG. 12 is a perspective view of a guide unit and a feeding roller device in an image forming apparatus according to still another embodiment of the present disclosure.
Figure 13:
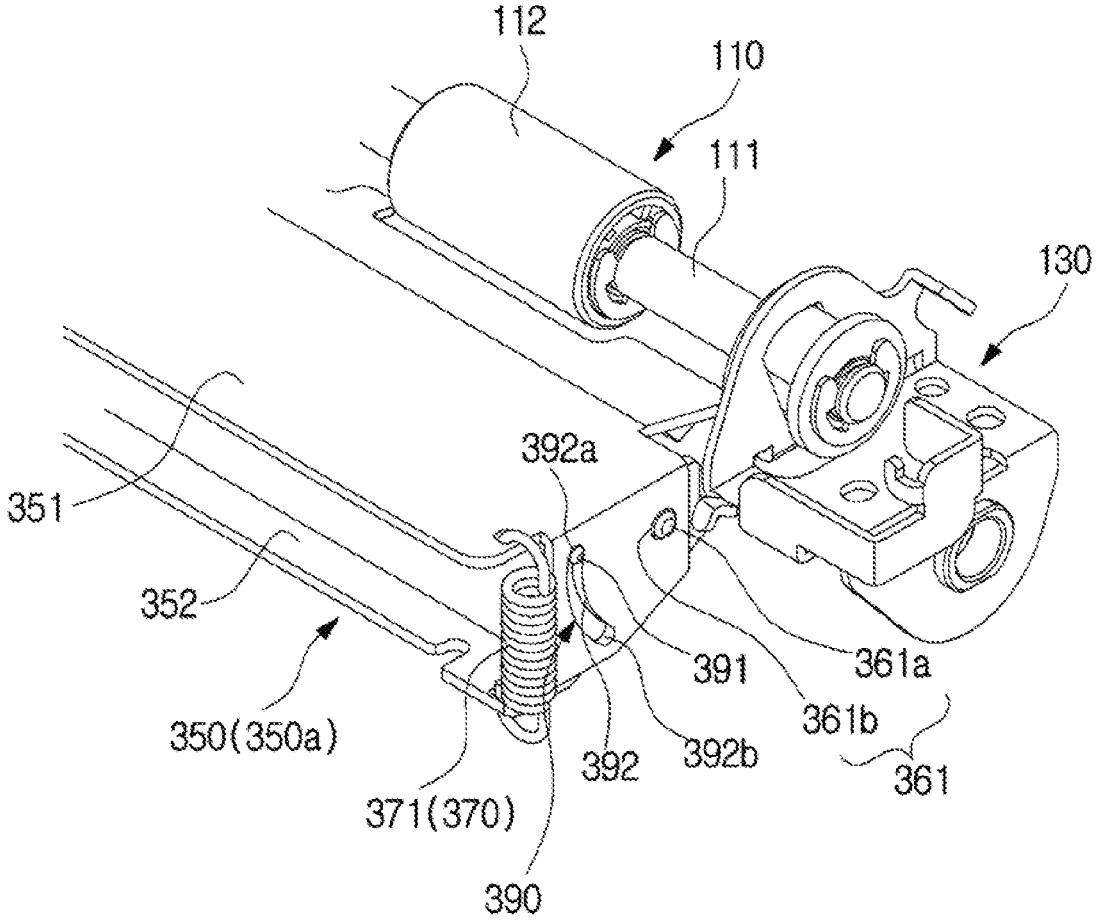
FIGS. 13 and 14 are enlarged views of a portion of the guide unit and the feeding roller device illustrated in FIG. 12.
Figure 14:
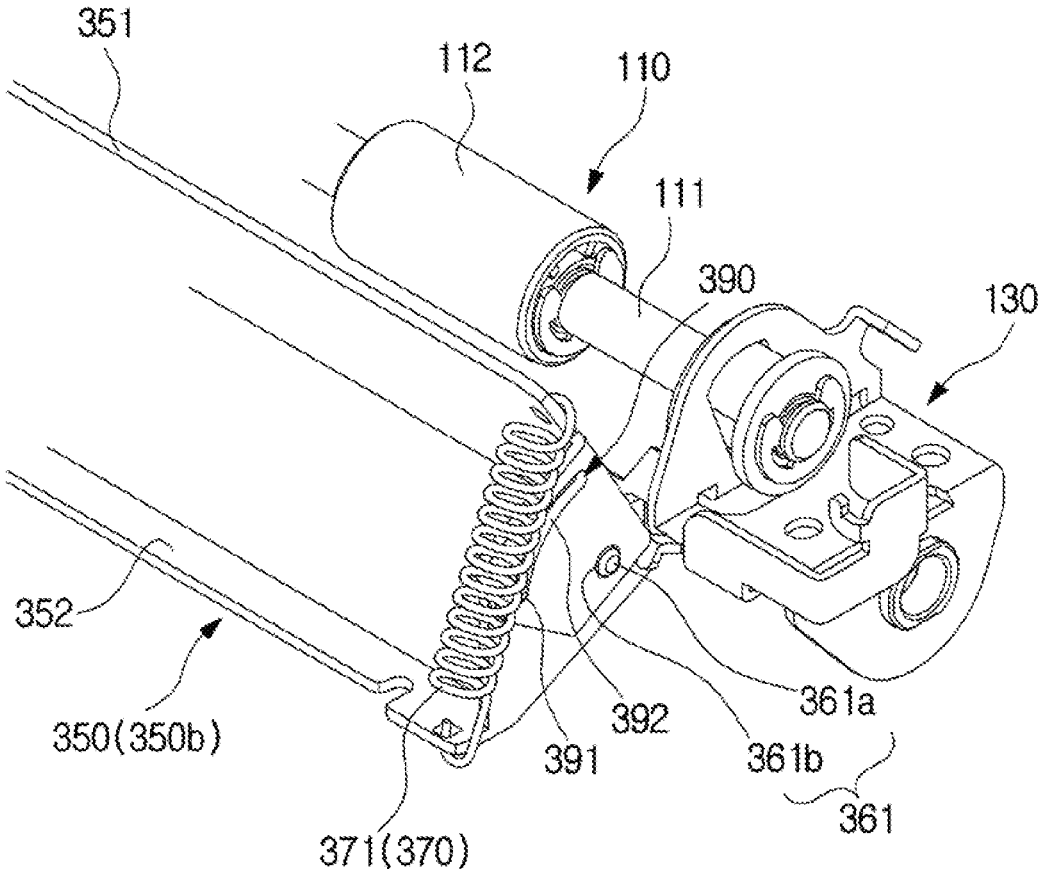
Figure 15:
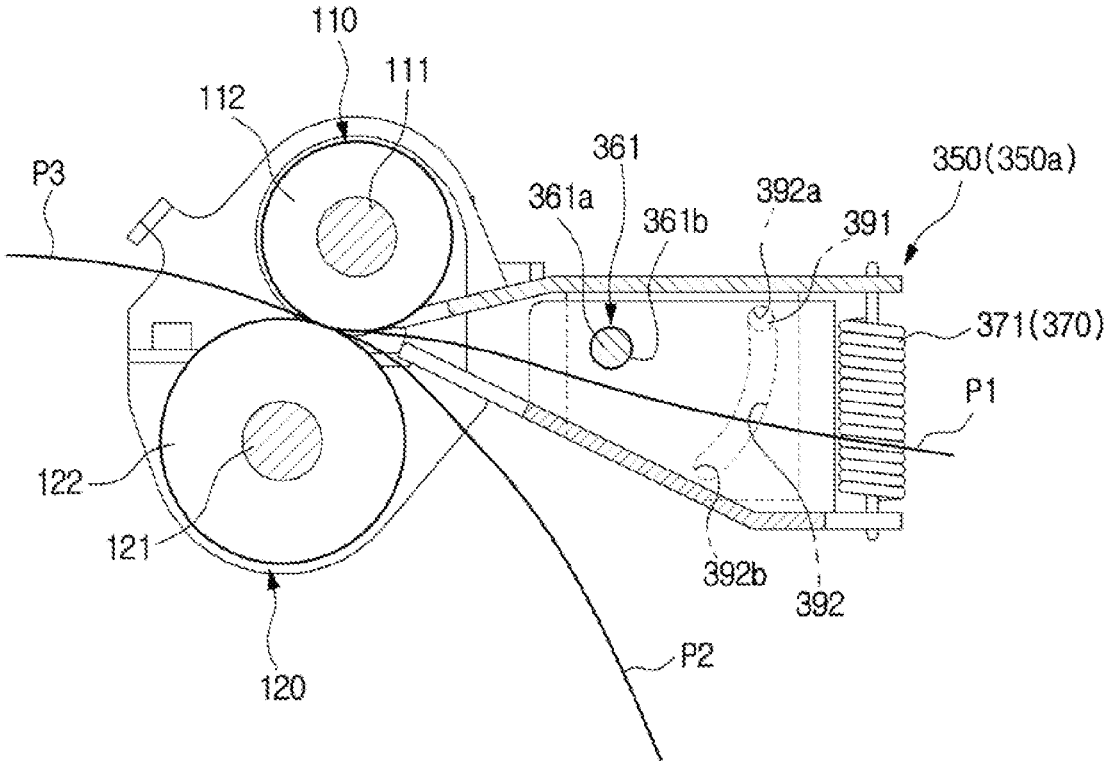
FIGS. 15, 16 and 17 are views for an operation of the guide unit and the feeding roller device illustrated in FIG. 12.
Figure 16:
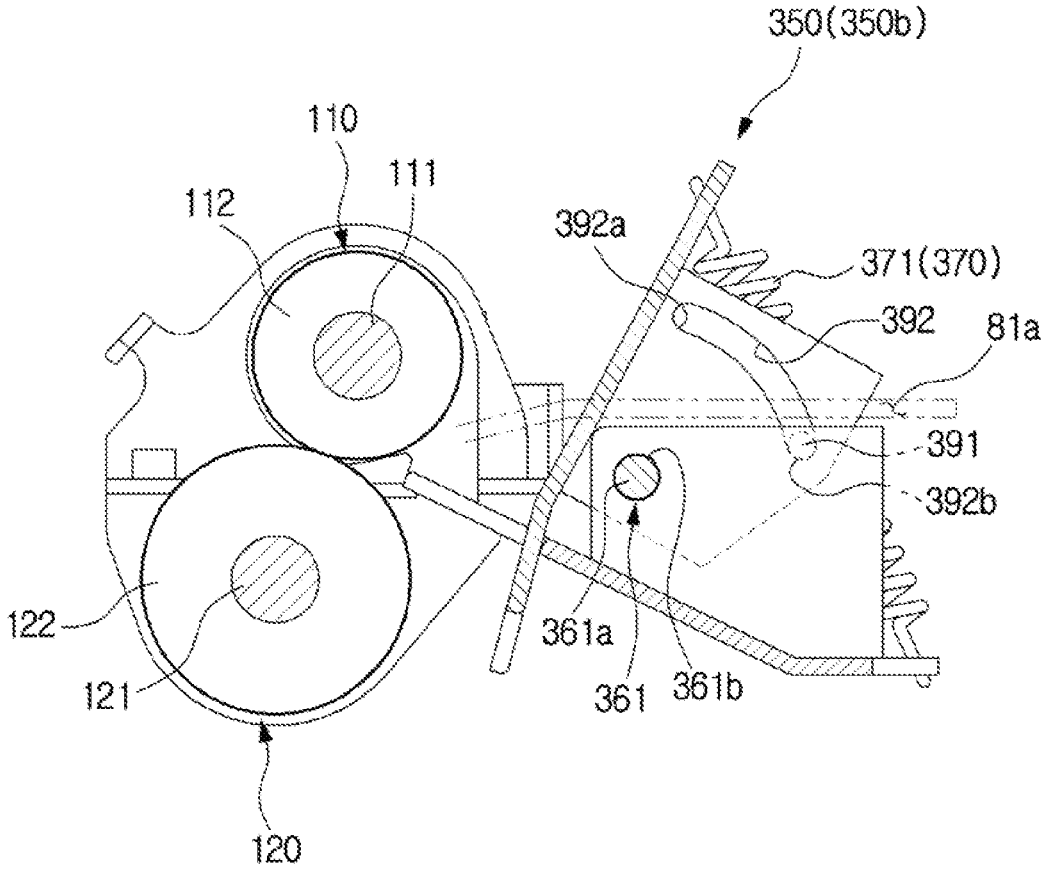
Figure 17:
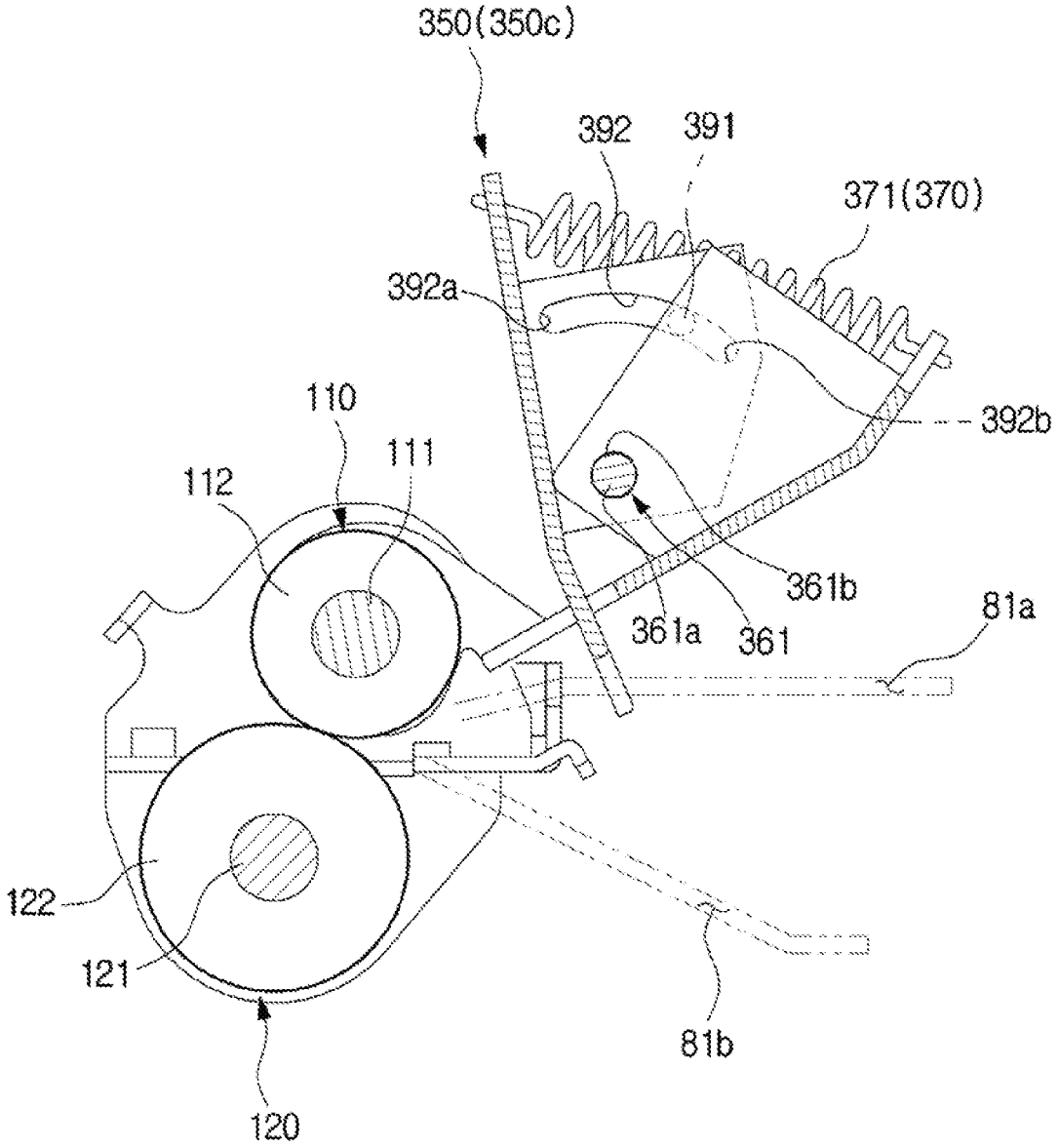

FIG. 12 is a perspective view of a guide unit and a feeding roller device in an image forming apparatus according to still another embodiment of the present disclosure FIGS. FIGS. 13 and 14 are enlarged views of a portion of the guide unit and the feeding roller device illustrated in FIG. 12. FIGS. 15, 16 and 17 are views for an operation of the guide unit and the feeding roller device illustrated in FIG. 12.

A guide unit 350 may include a first guide member 351 and a second guide member 352.

The guide unit 350 may include a guide rotating part 360 provided to rotate the first guide member 351 and the second guide member 352.

The guide rotating part 360 may include a first rotating part 361 provided to rotate the first guide member 351 with respect to the second guide member 352, and a second rotating part 162 provided to rotate the second guide member 352 with respect to the feeding roller device 100. The second rotating part 162 has the same configuration as the second rotating part 162 of the embodiment in FIGS. 2 and 4.

The first rotating part 361 may be provided to rotate the first guide member 351 with respect to the second guide member 352. In detail, the first rotating part 361 may include a rotating protrusion 361*a* formed on any one guide member of the first guide member 351 and the second guide member 352, and a rotating groove 361*b*, which is formed in the other guide member, into which the rotating protrusion 361*a* is rotatably inserted. In the embodiment, the rotating groove 361*b* is provided at the first guide member 351, and the rotating protrusion 361*a* is provided in the second guide member 352. The rotating protrusion 361*a* is inserted into the rotating groove 361*b* and rotated, and the first guide member 351 is rotatably provided with respect to the second guide member 352.

A plurality of guide members of the guide unit 350 are provided to be sequentially rotated and moved. The guide unit 350 is provided to be moved to a guide position 350*a*, a first open position 350*b*, and a second open position 350*c*. Descriptions of the guide position 350*a*, the first open position 350*b*, and the second open position 350*c* are the same as those described with reference to FIGS. 7 to 11.

The guide unit 350 may include a unit elastic member 370.

The unit elastic member 370 is provided for elastically returning the guide unit 350 from the first open position 350*b* or the second open position 350*c*.

The unit elastic member 370 may include a first elastic member 371 by which the first guide member 351 is elastically returned from the first open position 350*b*, and a second elastic member 170 by which the second guide member 352 is elastically returned from the second open position 350*c*. The second elastic member has the same configuration as the unit elastic member 170 of FIGS. 3 and 4.

The first elastic member 371 is provided to have one end to support the first guide member 351, and for the other end to support the second guide member 352. In the above configuration, when the guide unit 350 is moved from the guide position 350*a* to the first open position 350*b* by applying an external force to the guide unit 350, an elastic force is generated in the first elastic member 371. Further, when the external force with respect to the guide unit 350 is released, the first guide member 351 is elastically returned by the elastic force generated in the first elastic member 371.

The guide unit 350 may include a movement limiting part 390.

The movement limiting part 390 is provided to restrict the movement of the first guide member 351. The movement limiting part 390 may be provided so that the first guide member 351 is in contact with the second guide member 352 to rotate the second guide member 352. In detail, the movement limiting part 390 may include a movement protrusion 391 formed on any one guide member of the first guide member 351 and the second guide member 352, and a movement rail 392 formed on the other guide member and provided to rotate the movement protrusion 391. In the embodiment, the movement rail 392 may be formed on the first guide member 351 and the movement protrusion 391 may be formed on the second guide member 352.

Since the movement protrusion 391 is provided to move along the movement rail 392 and the first guide member 351 rotationally moves about the rotating protrusion 361*a*, the movement rail 392 may be formed in an arc shape. The movement rail 392 may include a first end portion 392*a* which restricts the upward movement of the movement protrusion 391, and a second end portion 392*b* which restricts the downward movement of the movement protrusion 391.

The operation of the movement limiting part 390 associated with operation of the guide unit 350 will be described.

When the guide unit 350 is positioned at the guide position 350*a*, the movement protrusion 391 may be provided to be positioned at the first end portion 392*a* of the movement rail 392. The movement protrusion 391 prevents any further upward movement at the first end portion 392*a*, and thereby, constantly maintains a gap between the first guide member 351 and the second guide member 352.

When the guide unit 350 is moved from the guide position 350*a* to the first open position 350*b*, the movement protrusion 391 is moved along the movement rail 392 to the second end portion 392*b* of the movement rail 392. Therefore, the gap between the first guide member 351 and the second guide member 352 may be not widened more than a certain gap.

When the guide unit 350 is moved from the first open position 350*b* to the second open position 350*c*, the movement protrusion 391 is positioned at the second end portion 392*b* of the movement rail 392 and moved with the first guide member 351 and the second guide member 352.

Hereafter, yet another embodiment of the present disclosure will be described.

Descriptions of configurations the same as described above will be omitted.

Figure 18:
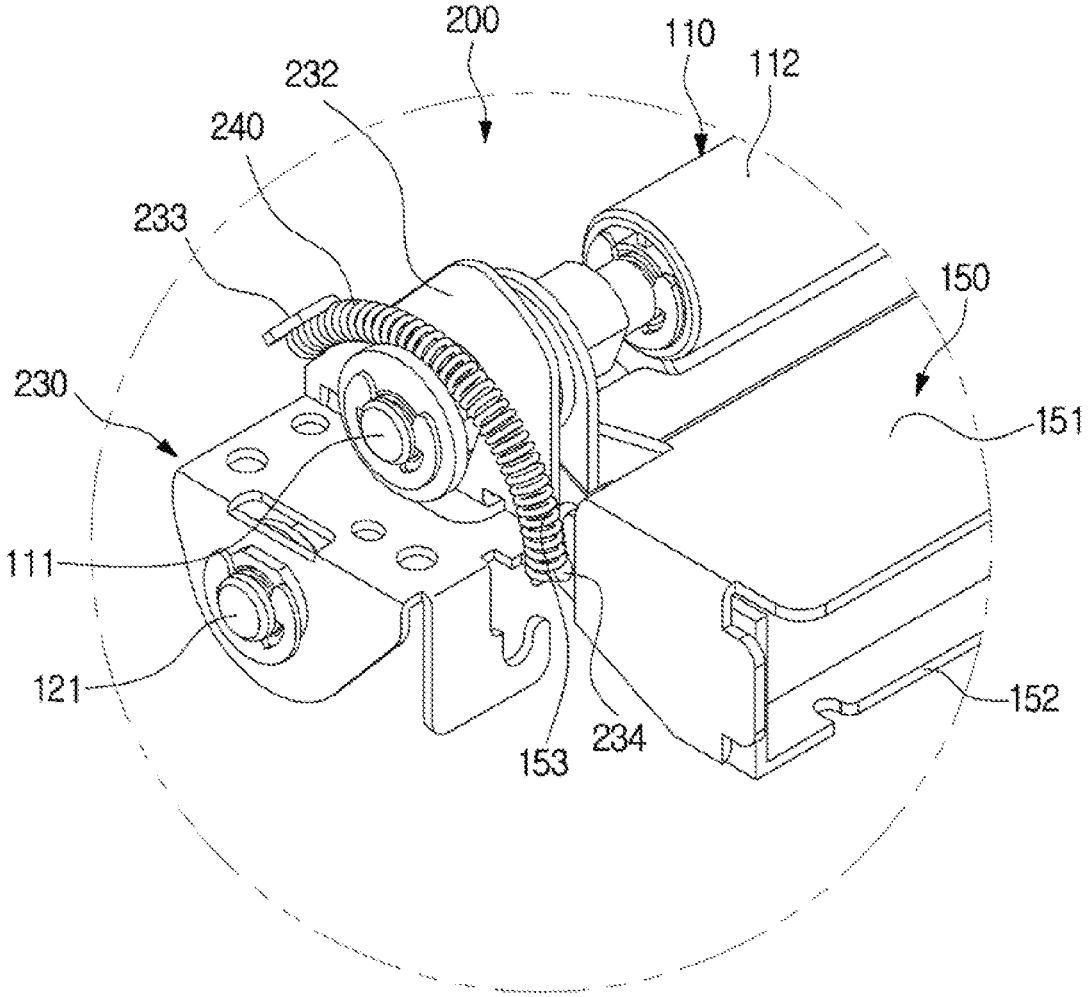
FIG. 18 is a view for a guide unit and a feeding roller device in an image forming apparatus according to yet another embodiment of the present disclosure.
Figure 19:
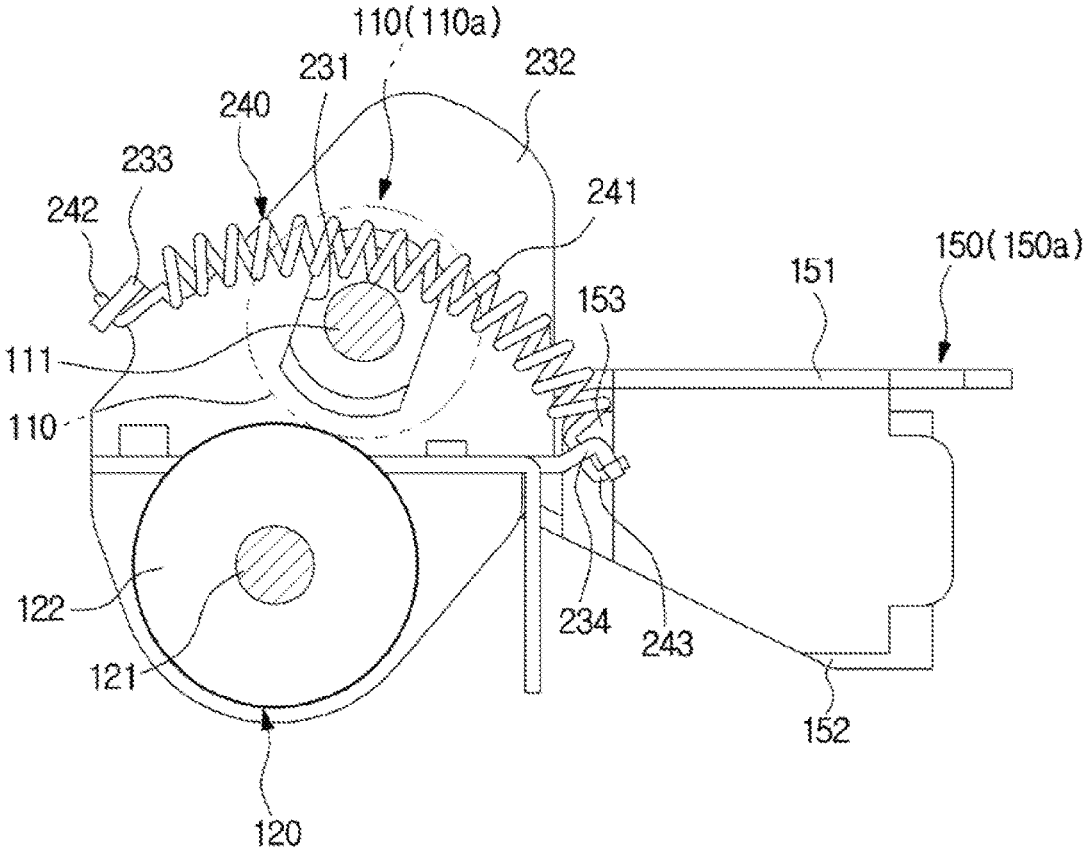
FIGS. 19 and 20 are views for an operation of the guide unit and the feeding roller device illustrated in FIG. 18.
Figure 20:
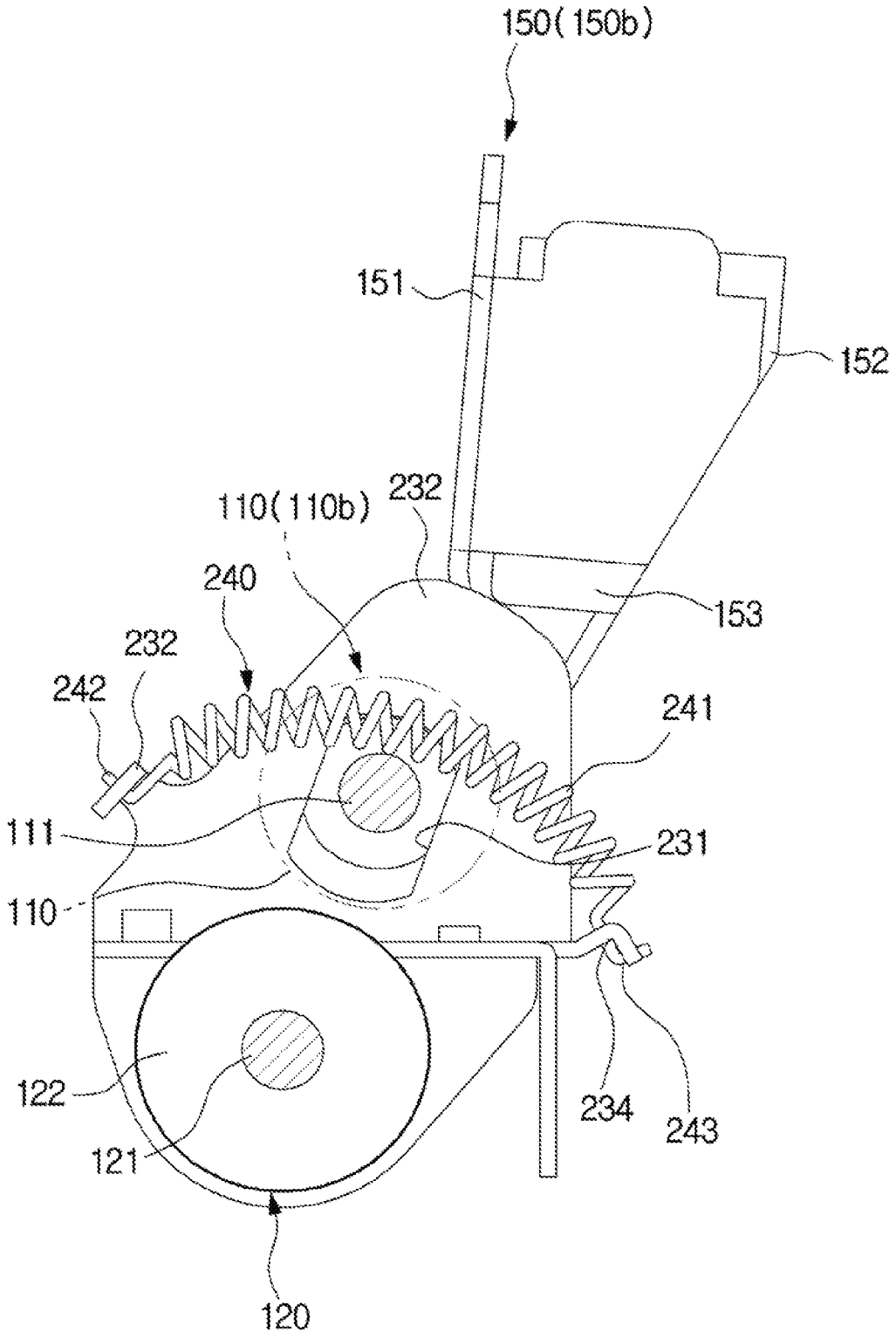

FIG. 18 is a view for a guide unit and a feeding roller device in an image forming apparatus according to yet another embodiment of the present disclosure, and FIGS. 19 and 20 are views for an operation of the guide unit and the feeding roller device illustrated in FIG. 18.

In the embodiment, a configuration in which a first feeding roller 110 and a second feeding roller 120 of a feeding roller device 200 are separated, and then, when the printing medium is jammed between the first and second feeding rollers 110 and 120, a configuration for easily removing the printing medium will be described.

The feeding roller device 200 may include a roller bracket 230.

The roller bracket 230 may be provided to rotatably support both ends of the first feeding roller 110 and the second feeding roller 120 to rotate the first feeding roller 110 and the second feeding roller 120. The roller bracket 230 is provided to be fixed to a main body 10 while supporting the rotation of feeding rollers 110 and 120.

The roller bracket 230 may be provided to be moved in a direction in which the first feeding roller 110 is separated from the second feeding roller 120. That is, the first feeding roller 110 may include a roller rail 231 which is provided to be moveable in a back and forth direction with respect to the second feeding roller 120. When the guide unit 150 is positioned at the guide position 150*a*, the position of the first feeding roller 110 may be referred to as a contact position 110*a* and the position to which the first feeding roller 110 moves relatively farther away from the second feeding roller 120 than at the contact position 110*a* may be referred to as a separated position 110*b*. That is, a position where the first feeding roller 110 is in contact with the second feeding roller 120 to allow the printing medium to pass through therebetween may be referred to as the contact position 110*a*, and a position to which the first feeding roller 110 moves relatively farther away from the second feeding roller 120 than at the contact position 110*a* may be referred to as the separated position 110*b*.

The feeding roller device 100 may be in contact with the guide unit 150 while the guide unit 150 is rotated, and thus include a lifting guide part 232 to guide the position movement of the first feeding roller 110.

The roller bracket 230 may include the lifting guide part 232. The roller rail 231 may be formed at the lifting guide part 232. The lifting guide part 232 may be formed in a direction perpendicular to the axis of rotation of the first feeding roller 110 and in a plate shape. The lifting guide part 232 is brought into contact with a lifting part 153 formed at the guide members 151 and 152 and the contact position is also changed according to the movement of the guide unit 150.

The lifting guide part 232 may be formed in a long shape in a direction in which the roller rail 231 is formed. With the long shape, when the guide unit 150 is positioned at the guide position 150*a*, the first feeding roller 110 is positioned at the contact position 110*a*, and when the guide unit 150 is positioned at the open position 150*b*, the second feeding roller 120 is positioned at the separated position 110*b*. That is, while the guide unit 150 is rotated around the first feeding roller 110, the guide unit 150 is moved from the guide position 150*a* to the open position 150*b*, and the guide unit 150 may be provided to be restricted by the lifting guide part 232 and moved so that the first feeding roller 110 is moved in a direction in which the first feeding roller 110 moves away from the second feeding roller 120.

The feeding roller device 100 may include a pressing elastic member 240.

Both ends of the pressing elastic member 240 are fixed to the roller bracket 230 and the body thereof is provided to be in contact with the first rotating shaft 111 and to press the first feeding roller 110 toward the second feeding roller 120. In detail, one end 242 and the other end 243 of the pressing elastic member 240 are respectively fixed to a first elastic hook 233 and a second elastic hook 234 which are provided at the roller bracket 230 at both ends of the first feeding roller 110, and a body 241 of the pressing elastic member 240 is provided to press the first feeding roller 110 toward the second feeding roller 120.

With the above configuration, the pressing elastic member 240, when the first feeding roller 110 is positioned at the contact position 110*a*, presses the first feeding roller 110 so as not to be arbitrary separated from the second feeding roller 120, and when the first feeding roller 110 is positioned at the separated position 110*b*, allows the first feeding roller 110 to be elastically returned to the contact position 110*a*.

In the above configuration, when the printing medium is jammed in the feeding roller device 100, the printing medium may be easily removed by separating the feeding rollers 110 and 120.

As is apparent from the above description, the printing medium jammed inside a main body can be easily removed in a process of supplying a printing medium.

Further, since the plurality of printing medium feeding and delivering paths can be easily accessed, the printing medium jam can be effectively cleared.

The present disclosure has been described in detail with reference to the exemplary embodiments. However, the exemplary embodiments should be considered in a descriptive sense only, and the disclosure is not limited thereto. It will be apparent to those skilled in the art that various modifications and improvements within the scope of the disclosure may be made.

What is claimed is:

1. An image forming apparatus comprising:

a main body;

a printing medium supply device configured to supply a printing medium to a first delivery path or a second delivery path;

a feeding roller device provided inside the main body to convey the printing medium upon receiving the printing medium supplied by the printing medium supply device via the first delivery path or the second delivery path; and a guide unit including:

a first guide member defining part of a boundary of the first delivery path to thereby guide the printing medium to the feeding roller device when the printing medium is supplied to the first delivery path, and rotatable in a first direction to open the first delivery path to thereby provide access to the printing medium when the printing medium is jammed in the first delivery path, and a second guide member defining part of a boundary of the second delivery path to thereby guide the printing medium to the feeding roller device when the printing medium is supplied to the second delivery path, and rotatable, along the first direction, together with the first guide member to open the second delivery path.

2. The apparatus of claim 1, wherein the second guide member is fixed to the first guide member.

3. The apparatus of claim 1, wherein the guide unit further includes:

a first coupling member attached to the first guide member; and a second coupling member attached to the second guide member and coupled with the first coupling member.

4. The apparatus of claim 1, wherein the first guide member is rotatable relative to the second guide member.

5. The apparatus of claim 4, wherein the guide unit further includes:

a first rotating part rotatably coupling the first guide member to a first center of rotation about which the first guide member is rotated with respect to the second guide member; and a second rotating part rotatably coupling the second guide member to a second center of rotation about which the first guide member is rotated together with the second guide member.

6. The apparatus of claim 1, wherein the second guide member is configured to be rotated along with the first guide member upon the first guide member having been rotated through a predetermined angle.

7. The apparatus of claim 6, wherein the guide unit further includes a movement limiting part by which an external force that is rotating the first guide member, having rotated through the predetermined angle, also rotate the second guide member.

8. The apparatus of claim 7, wherein the movement limiting part includes:

a movement rail provided at one of the first guide member and the second guide member; and a movement protrusion provided at the other of the first guide member and the second guide member, the movement protrusion being on the movement rail such that the movement rail defines a movement range of the movement protrusion relative to the movement rail.

9. The apparatus of claim 1, wherein the printing medium includes a first printing medium and a second printing medium, the printing medium supply device includes a first printing medium supply device to supply the first printing medium to the first delivery path, and a second printing medium supply device to supply the second printing medium to the second delivery path, the first and second printing medium supply devices being at different positions in the main body, the first guide member is disposed to guide the printing medium supplied by the first printing medium supply device to the feeding roller device to the first delivery path, and the second guide member is disposed to guide the printing medium supplied by the second printing medium supply device to the feeding roller device to the second delivery path.

10. The apparatus of claim 9, wherein the first guide member and the second guide member are disposed so that the printing medium supplied by the first printing medium supply device passes between the first guide member and the second guide member, and the printing medium supplied by the second printing medium supply device passes under the second guide member.

11. An image forming apparatus comprising:

a main body;

a printing medium supply device configured to supply a printing medium;

a feeding roller device provided inside the main body to convey the printing medium upon receiving the printing medium supplied by the printing medium supply device, the feeding roller device including a first feeding roller having a rotating shaft; and a guide unit disposed to guide the printing medium supplied by the printing medium supply device to the feeding roller device, the guide unit including:

a first guide member rotatable in a first direction to provide access to the printing medium when the printing medium is jammed inside the main body, and a second guide member provided to be rotatable, along the first direction, together with the first guide member, wherein the first guide member and the second guide member are configured to be rotated about the rotating shaft.

12. The apparatus of claim 11, wherein the feeding roller device further includes a second feeding roller facing the first feeding roller, and the first feeding roller is movable between a first position where the first feeding roller is in contact with the second feeding roller and a second position where the first feeding roller is separated from the second feeding roller so that the printing medium is delivered.

13. The apparatus of claim 12, wherein the first feeding roller is configured to move to the second position in association with the rotation of the first guide member and the second guide member.

14. The apparatus of claim 12, wherein the feeding roller device further includes a lifting guide part which is in contact with the guide unit while the guide unit is rotated, and guides the movement of the first feeding roller.

15. An image forming apparatus comprising:

a main body;

a first printing medium supply device and a second printing medium supply device, which respectively supply a first printing medium to a first delivery path inside the main body and a second printing medium to a second delivery path inside the main body;

a feeding roller device disposed inside the main body to convey the first printing medium upon receiving the first printing medium supplied by the first printing medium supply device via the first delivery path, and to convey the second printing medium upon receiving the second printing medium supplied by the second printing medium supply device via the second delivery path; and a guide unit including a first guide member defining part of a boundary of the first delivery path to thereby guide the first printing medium to the feeding roller device, and rotatable in a first direction to open the first delivery path to thereby provide access to the first printing medium when the first printing medium is jammed in the first delivery path, and a second guide member defining part of a boundary of the second delivery path to thereby guide the second printing medium to the feeding roller device, the second guide member being rotatable, independently of the second guide member, to open the second delivery path to thereby provide access to the second printing medium when the second printing medium is jammed in the second delivery path.

16. The apparatus of claim 15, wherein the second guide member is configured to be rotated along with the first guide member upon the first guide member having rotated through a predetermined angle with respect to the second guide member.

17. The apparatus of claim 15, wherein the first guide member is rotatably coupled to the second guide member.

18. The apparatus of claim 15, wherein the feeding roller device includes a first feeding roller having a rotating shaft, and the second guide member is rotatably coupled to the rotating shaft.

19. The apparatus of claim 18, wherein the first feeding roller is configured to move in a direction perpendicular to an axial direction of the first feeding roller in association with a rotation of the guide unit.

20. The apparatus of claim 15, wherein the guide unit further includes an elastic member which elastically supports at the first guide member and the second guide member.

* * * * *